US011358206B1

(12) United States Patent
Poppler et al.

(10) Patent No.: US 11,358,206 B1
(45) Date of Patent: Jun. 14, 2022

(54) TUBULAR JOINT ROLL FORMING MACHINE

(71) Applicant: KNIGHT MFG., LLC, Brookfield, WI (US)

(72) Inventors: Marcus Lee Poppler, Racine, WI (US); Nathan Michael McCrimmon, Sussex, WI (US)

(73) Assignee: KNIGHT MFG., LLC, Brookfield, WI (US)

( * ) Notice: Subject to any disclaimer, the term of this patent is extended or adjusted under 35 U.S.C. 154(b) by 0 days.

(21) Appl. No.: 17/149,413

(22) Filed: Jan. 14, 2021

(51) Int. Cl.
*B21D 39/04* (2006.01)

(52) U.S. Cl.
CPC ..... *B21D 39/048* (2013.01)

(58) Field of Classification Search
CPC .... B65B 9/22; B65B 9/24; B21H 8/00; B21H 1/20; B21H 7/182; B65H 5/025; B21D 5/08; B21D 5/06; B21D 5/12; B21D 39/048
See application file for complete search history.

(56) References Cited

U.S. PATENT DOCUMENTS

| | | | |
|---|---|---|---|
| 1,473,756 | A | 11/1923 | Brogden |
| 1,587,158 | A | 6/1926 | Husid |
| 2,219,993 | A | 10/1940 | Holub |
| 3,438,238 | A | 4/1969 | Crowe et al. |
| 3,636,903 | A | 1/1972 | Anderson et al. |
| 3,670,553 | A | 6/1972 | Nothum et al. |
| 3,861,184 | A | 1/1975 | Knudson |
| 5,836,194 | A | 11/1998 | Micouleau et al. |
| 6,854,313 | B2 | 2/2005 | Knudson et al. |
| 10,537,925 | B2 | 1/2020 | Klingesberger et al. |
| 2004/0025559 | A1 | 2/2004 | Knudson et al. |

OTHER PUBLICATIONS

Uniflex hydraulic hose crimper, https://www.uniflex-hydraulics.com/products/production-crimpers/hm-3-h/, accessed Feb. 26, 2021.
Beckhoff motion profile program (TWIN CAT), https://www.beckhoff.com/en-en/support/download-finder/software-and-tools/, accessed Feb. 26, 2021.
Sheet Metal Automation—Machine Specs, http://www.smaemm.com/machine_specs, accessed Feb. 26, 2021.

(Continued)

*Primary Examiner* — Lee A Holly
(74) *Attorney, Agent, or Firm* — Andrus Intellectual Property Law, LLP

(57) ABSTRACT

A roll forming machine for continuously forming a sheet into a joint section of a tube may include a plurality of roller stations arranged longitudinally on a frame and configured to bend the sheet to form the tube, and a carriage slidably secured to the frame. A pleat die assembly may be mounted on the carriage and can be configured to repeatedly engage the tube to form a series of pleats thereby bending the tube to form the joint section. A crimp die assembly may be mounted on the carriage and can be configured to engage the tube to crimp an end of the joint section and sever the end of the joint section from the tube. The carriage may be configured to be selectively moved relative to the frame while the tube is engaged with at least one of the crimp die assembly and the pleat die assembly.

9 Claims, 34 Drawing Sheets

(56) References Cited

OTHER PUBLICATIONS

Grover Machine Downspout Machines, https://www.grovermachine.com/downspout.html, accessed Feb. 26, 2021.
Downspout Machines—Roll Forming Equipment, https://jobsite-us.com/rollformingequipment/downspout-machines/, accessed Feb. 26, 2021.
CNC machining centers CNC Controls, https://www.mazakusa.com/machines/technology/cnc-controls/, accessed Feb. 26, 2021.
Machinery's Handbook, Industrial Press, excerpt of pp. 2070-2071.
Cam Design and Manufacturing Handbook, 2nd Ed. (vol. 1): Norton, Robert: 9780831133672, excerpt of pp. 155-157.

TUBULAR JOINT ROLL FORMING MACHINE

FIELD

The present disclosure relates generally to roll forming machines, and in particular, roll forming machines for producing tubular joints.

BACKGROUND

Roll forming machines may be configured to bend an elongated sheet of material into a desired shape as the sheet moves though a plurality of roller stations arranged along the length of the roll forming machine. At each station, the sheet passes through one or more rollers that bend the sheet to alter its cross-sectional profile. Roll forming machines can be configured to produce elongated features with a variety of different cross-sectional shapes. For example, roll forming can be used to produce parts with open cross-sections, such as a U-shaped channel, as well as parts with closed cross-sections, such as a circular pipe.

To break the elongated roll formed components into smaller, separate sections, some roll forming machines can include secondary cutting mechanisms configured to cut the elongated component after the desired cross-sectional shape has been achieved. Cutting mechanisms may also be configured to crimp the end of a component so that it may fit within another part. Further, some roll forming machines can include secondary bending mechanisms configured to bend the elongated component to produce curved features with the desired cross-sectional shapes.

SUMMARY

To consistently and reliably cut, crimp, or bend roll formed components, existing roll forming machines temporally stop the roll forming process while the cutting, crimping, or bending operations are performed. The repeated starting and stopping of the roll forming machine increases wear on the drivetrain of these traditional roll forming machines. Even briefly stopping the roll forming process also decreases the rate at which parts are produced.

The present disclosure relates to a roll forming machine configured to cut, crimp, and bend roll formed tubes without starting and stopping the roll forming process. The present roll forming machine uses a cutting/crimping mechanism and a pleat mechanism that are configured to move with the roll formed tube relative to the primary roll forming components in order to perform cutting/crimping and bending operations continuously.

In some embodiments, a roll forming machine may be configured for continuously forming a sheet into a joint section of a tube. The roll forming machine may include a frame having a front end and a back end, a plurality of roller stations arranged longitudinally on the frame between the front end and the back end, and a carriage, which may be slidably secured to the frame. Each rolling station may be configured to move the sheet along the frame from the front end to the back end and to bend the sheet to form the tube. A pleat die assembly may be mounted on the carriage and may be configured to repeatedly engage the tube to form a series of pleats, thereby bending the tube to form the tubular joint section. A crimp die assembly may be mounted on the carriage and may be configured to engage the tube to crimp an end of the joint section and sever the end of the joint tube section from the tube. The carriage may move relative to the frame while the tube is engaged with at least one of the crimp die assembly and the pleat die assembly.

In some embodiments, a roll forming machine may be configured to continuously form a sheet of material into a tubular joint at an operational speed. The roll forming machine may include a frame having a first end and a second end, a plurality of roller stations arranged longitudinally on the frame and configured to move the sheet of material along the frame from the first end to the second end and to bend the sheet of material into the tubular joint section, and a carriage slidably secured proximate to the second end of the frame and configured to be selectively moved relative to the frame. A pleat die assembly may be mounted on the carriage, and the pleat die assembly may include a plurality of reciprocating pleat die members. A crimp die assembly may be mounted on the carriage adjacent to the pleat die assembly, and the crimp die assembly may include a plurality of reciprocating crimp die members. A carriage actuator may be configured to generally match the operational speed such that the pleat die assembly and the crimp die assembly are configured to continuously form the sheet of material as the sheet of material moves along the frame from the first end to the second end.

Some embodiments may include a method for forming a joint section from a tube that is continuously formed from a sheet of material with a roll forming machine. The method may include steps for continuously advancing the sheet of material through a plurality of roller stations to bend the sheet of material to form the tube, sliding, with a carriage actuator, a carriage longitudinally relative to a frame of the roll forming machine such that the carriage moves with the tube, bending, with a pleat assembly positioned on the carriage, the tube to form the joint section, and severing, with a crimp assembly positioned on the carriage, the joint section from the tube.

Various other features, objects, and advantages will be made apparent from the following description taken together with the drawings.

BRIEF DESCRIPTION OF THE DRAWINGS

The present disclosure is described with reference to the following Figures.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different methods and assemblies described herein may be used alone.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "linked," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," "back," "left" or "right" features is generally intended as a description only of the orientation of such features relative to a reference frame of a particular example or illustration. Correspondingly, for example, a "top" feature may sometimes be disposed below a "bottom" feature (and so on), in some arrangements or embodiments. Additionally, use of the words "first," "second", "third," etc. is not intended to connote priority or importance, but merely to distinguish one of several similar elements or machines from another.

Figure 1:
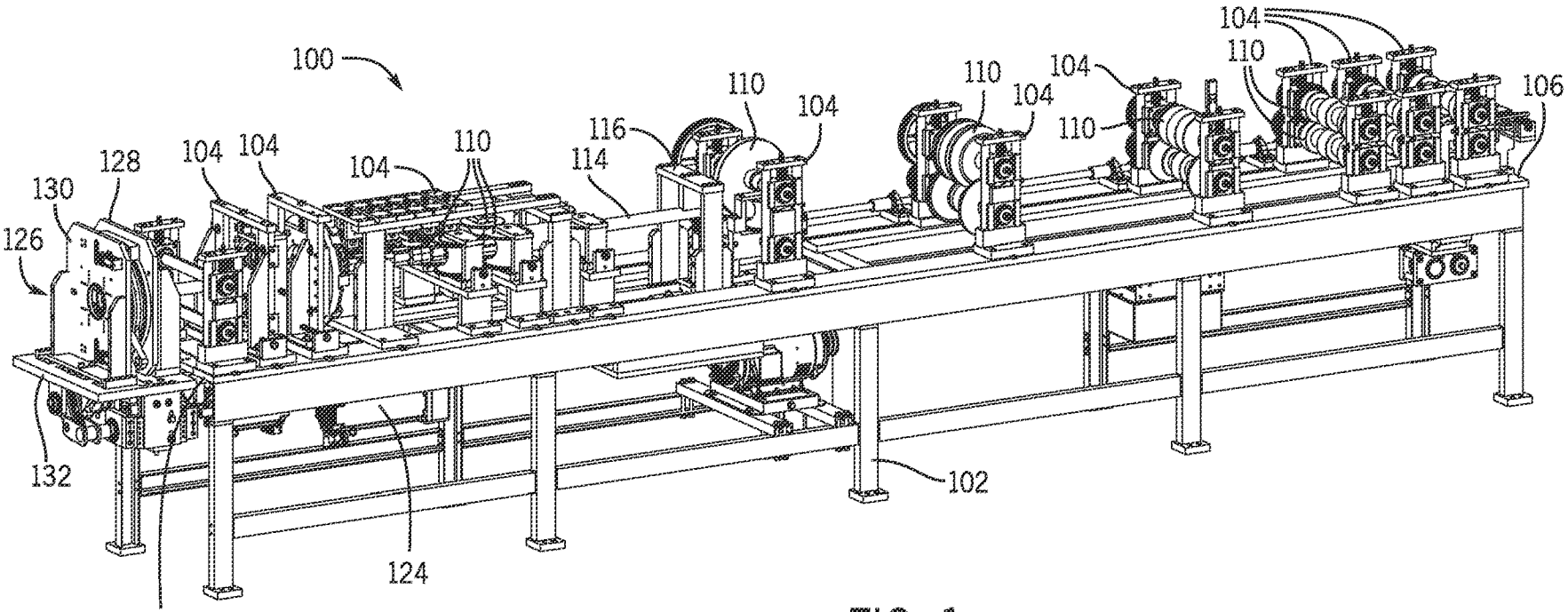
FIG. 1 is a perspective view of an embodiment of a roll forming machine including a joint-forming module with a reciprocating pleat die assembly.
Figure 2:
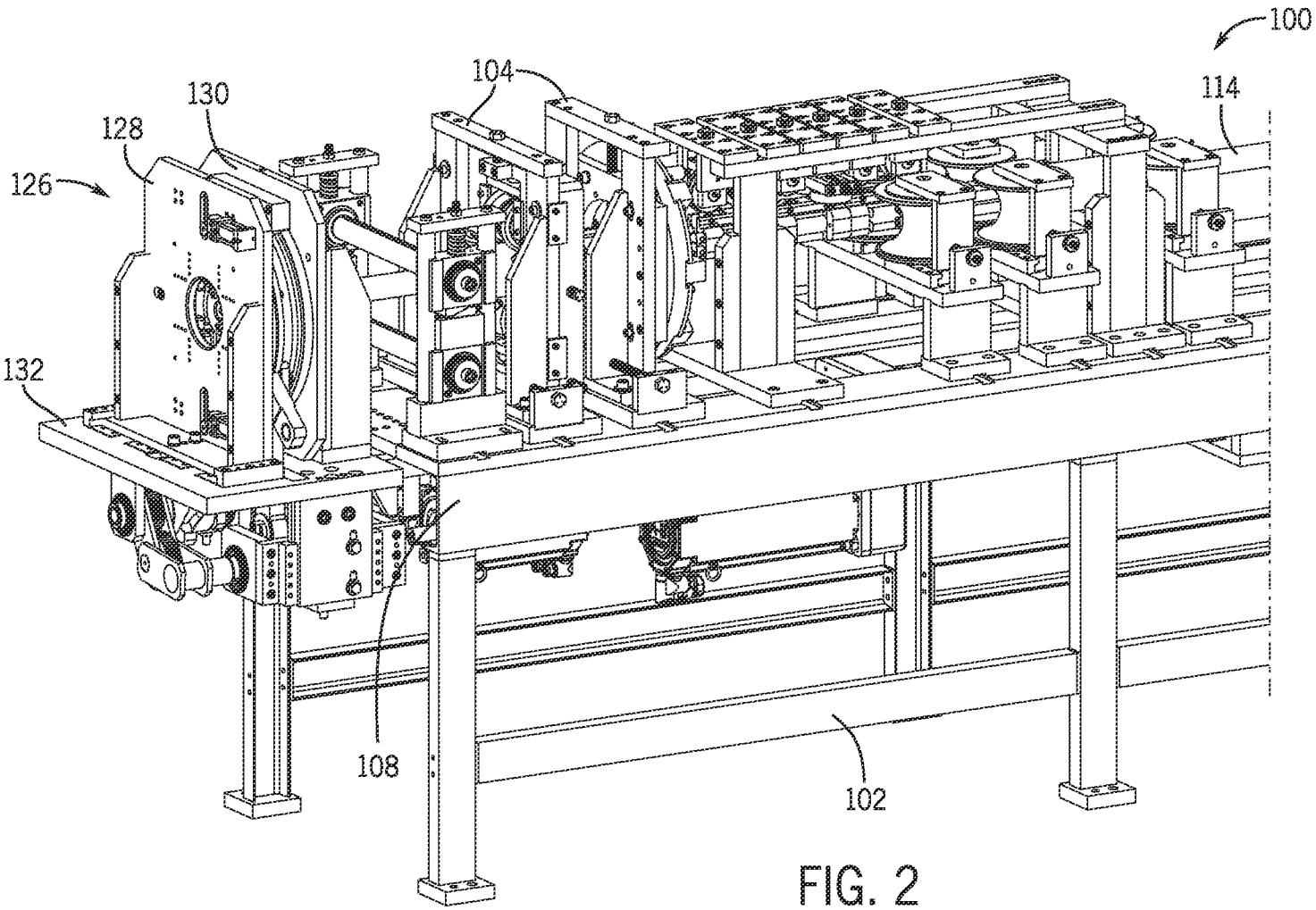
FIG. 2 is a detailed perspective view of the roll forming machine and joint module of FIG. 1.
Figure 3:
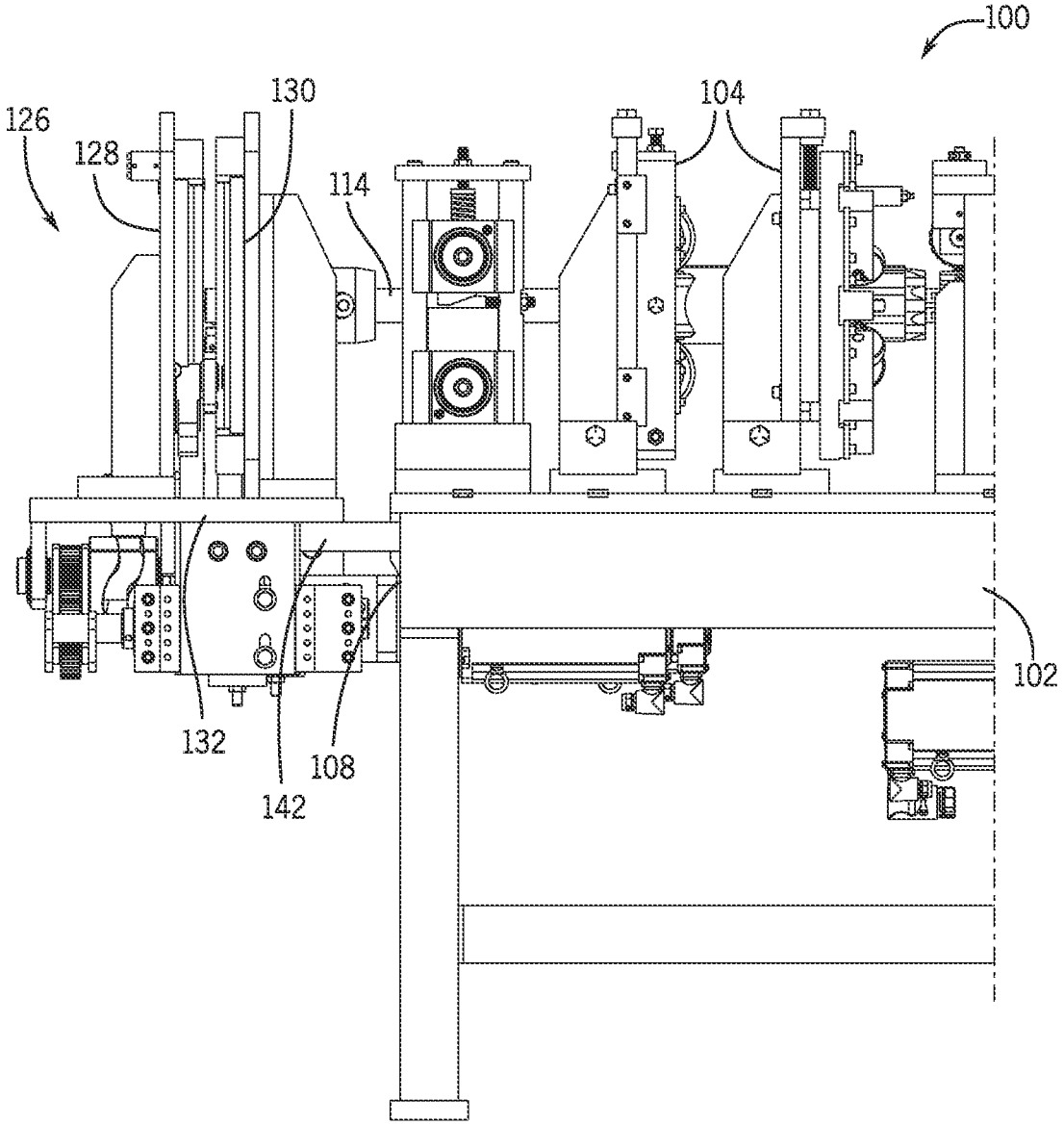
FIG. 3 is a side view of the roll forming machine and joint module of FIG. 2.
Figure 4:
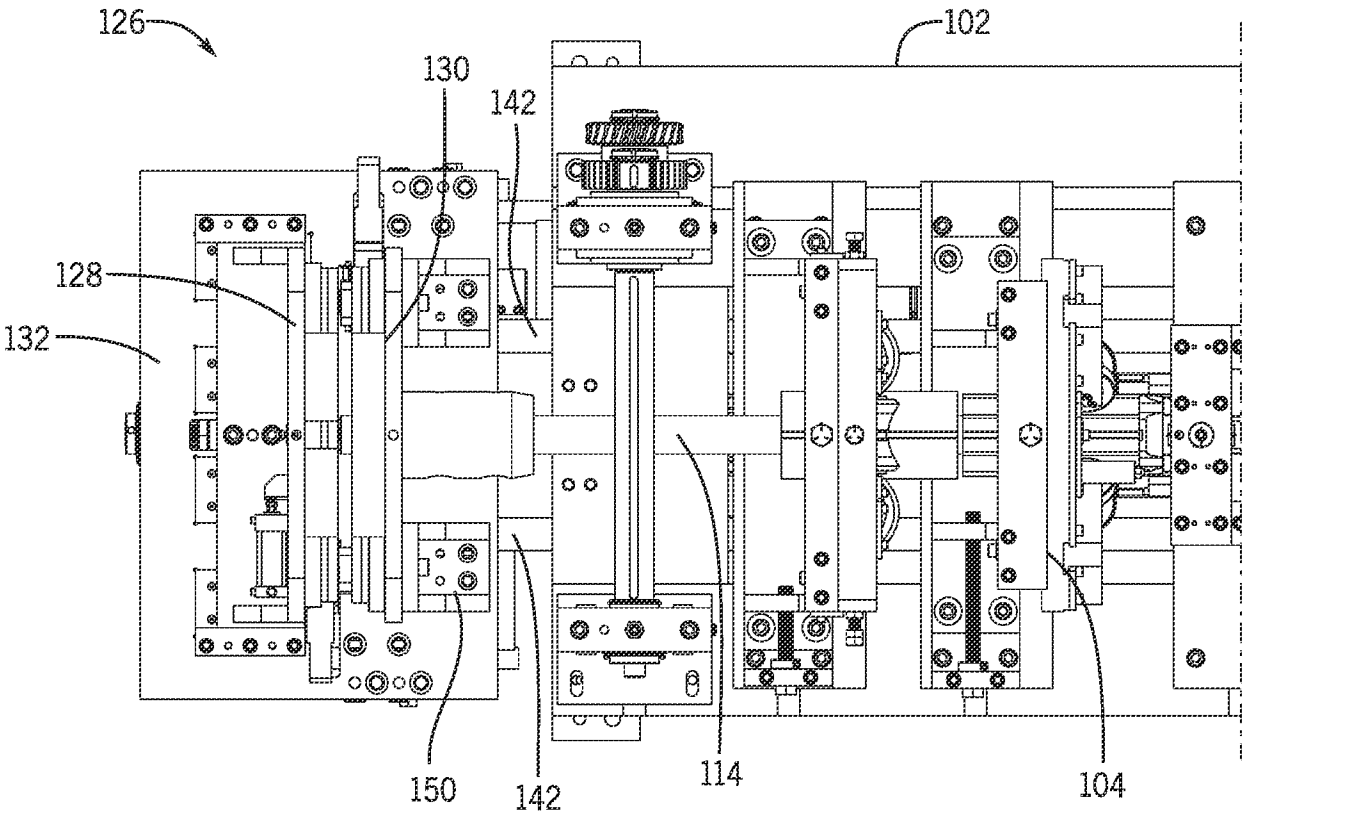
FIG. 4 is a top-down view of the roll forming machine and joint module of FIG. 3.
Figure 5:
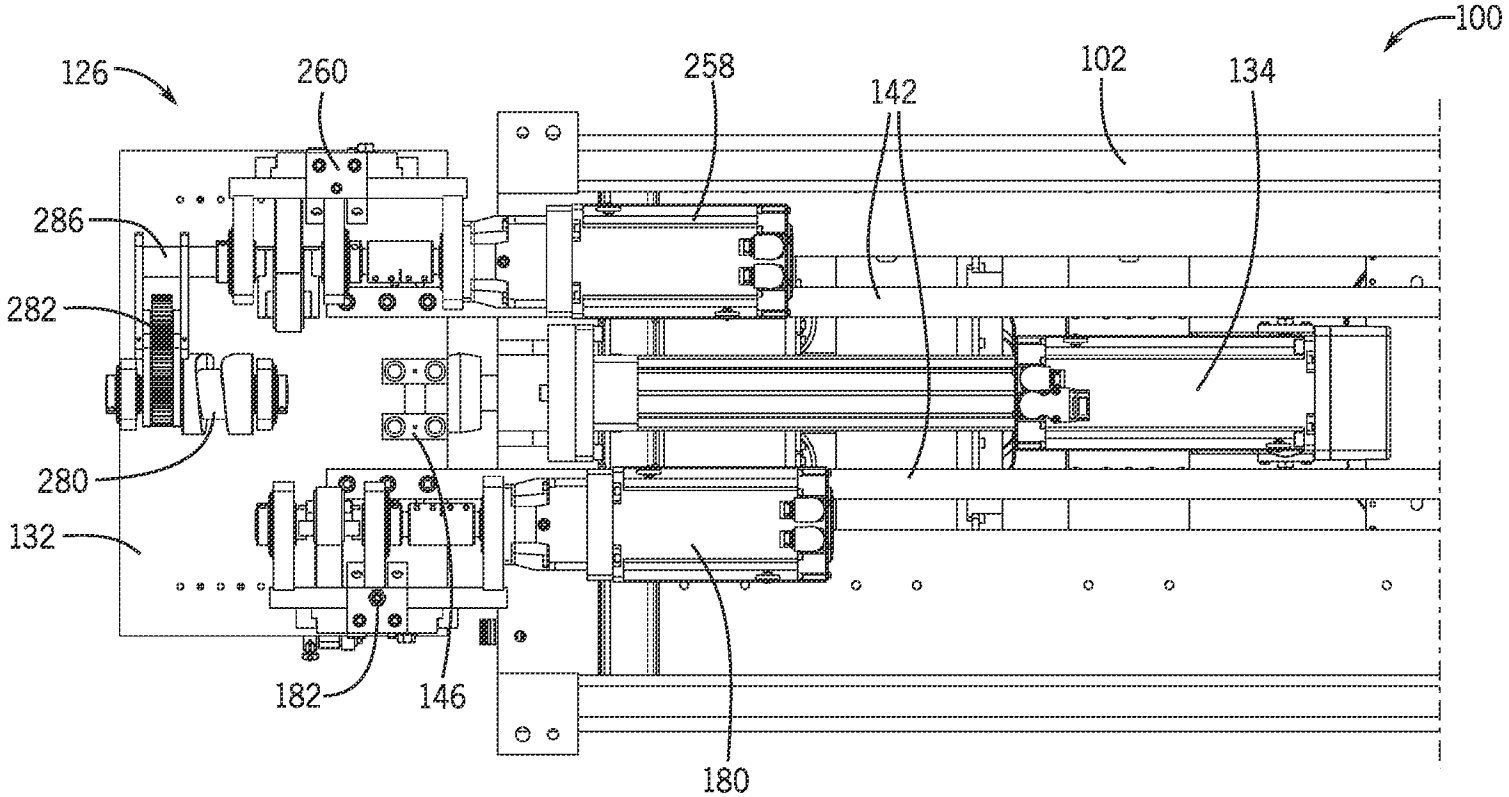
FIG. 5 is a bottom-up view of the roll forming machine and joint module of FIG. 4.

Referring now to the figures, FIG. 1 illustrates an embodiment of a roll forming machine 100 configured to receive a substantially planar sheet of material and bend the sheet into an elongated component through a continuous process at an operational speed. For example, the roll forming machine 100 may be configured to receive an elongated strip of sheet metal and bend it into a pipe, tube, and/or any other elongated shape of closed or open cross-sectional profile. The roll forming machine 100 may include a frame 102 with a plurality of roller stations arranged longitudinally between a front end 106 of the machine 100 and a back end 108 of the machine 100. The sheet is received by a first one of the roller stations 104 positioned proximate the front end 106, and then moves sequentially through each of the roller stations 104 as the sheet travels towards the back end 108 of the roll forming machine 100. At each roller station 104, the sheet passes through one or more rollers 110 that form the sheet of material to change its cross-sectional shape. As the sheet progresses through the roller stations 104, the planar sheet is incrementally bent into a desired shape before being discharged from the roll forming machine 100. In the illustrated embodiments, the roll forming machine 100 is configured to form a tube with a closed cross-sectional profile (e.g., a circular, ellipsoid, or rectangular tube). The roll forming machine 100 includes a shaft 114 that is mounted on the frame 102 by a shaft support 116, and which extends longitudinally along the length of the frame 102 from the shaft support 116 towards the back end 108 of the machine 100. The shaft 114 passes through a plurality of roller stations 104 positioned between the shaft support 116 towards the back end 108. The rollers 110 at these roller stations 104 are configured to bend the sheet around the shaft 114 to form a cross-sectional tube with the shaft 114 extending along the interior of the tube. Mandrels, bushings, or other features, which may be mounted on the shaft 114 and positioned within the tube, may be configured to work with the roller stations 104 to bend the sheet into the desired cross-sectional shape.

Some embodiments of a roll forming machine may include secondary systems configured to form tubular joint segments from the elongated tube produced by the roll forming machine. A joint section may be at least one of an angled elbow segment, an offset segment, a short or long non-pleated tube, and any other tube segment that is bent or curved to produce two or three dimensional geometry. As illustrated in FIGS. 1-5, for example, a roll forming machine 100 can include a joint module 126 positioned at the back end 108 and configured to further process the tube produced by the machine 100. After the roll formed tube passes through a final roller station of the roll forming process, continued movement of the sheet of material through the roll forming machine 100 may drive the roll formed tube into at least one of a pleat die assembly 128 and a crimp die assembly 130 of the joint module 126. The pleat die assembly 128 may be configured to bend the roll formed tube into a joint section by repeatedly pleating the sides of the tube. The crimp die assembly 130 may be configured to crimp one end of the joint section and cut the tube at the crimped end to sever the joint section from the elongated tube. The pleat die assembly 128 and the crimp die assembly 130 may be mounted on a carriage 132 that is slidably secured to the back end 108 of the frame 102. Using at least one actuator (e.g., carriage actuator 134 in FIG. 5), the carriage 132 may be selectively moved along the longitudinal direction towards and/or away from the back end 108 so that the carriage 132 moves with the elongated tube as it is continuously produced by the roll forming machine 100. This may be useful, for example, so that the pleat die assembly 128 and the crimp die assembly 130 can be used to continuously produce joint segments without starting and stopping the movement of the sheet of material through the roll forming machine 100 to perform pleating or crimping and cutting operations.

Having generally described features of a joint module 126 for a roll forming machine 100, the details of its components and their structure and features will now be discussed. As illustrated in FIGS. 6-12, the carriage 132 may include a base 140 with two rails 142 secured to a lower side of the base 140 and extending outwardly from a front side 144 thereof. The rails 142 may be configured to engage at least one rail support on the frame 102 to slidably secure the joint module 126 to the frame 102. In the illustrated embodiments, for example, the sliding interface between the rails 142 and the frame 102 allow the joint module 126 to be selectively extended or retracted by sliding away from or towards the back end 108 of the frame 102. Sliding movement of the joint module 126 may be controlled by a carriage actuator 134, which may be mounted on at least one of the carriage 132 and the frame 102. In the illustrated embodiment, the carriage actuator 134 is secured to the frame and is configured to be connected to an actuator coupling feature 146 that is positioned on the lower side of the base 140 between the two rails 142 (see, e.g., FIG. 5). In some embodiments, other carriage actuator configurations may be included. For example, a carriage actuator may be positioned in a different location on the frame, and/or a carriage actuator may be configured to engage the carriage at a different location. Further still, some embodiments may be configured with a carriage actuator mounted on the joint module and configured to engage a portion of the frame.

The upper surface of the base 140 of the carriage 132 may be configured to receive the pleat die assembly 128 and the crimp die assembly 130 so that they are in alignment with the roller stations 104 when the joint module 126 is received on the frame 102. As illustrated in FIGS. 1-4, the shaft 114 may extend past the back end 108 of the frame 102 so that it extends into at least one of the pleat die assembly 128 and the crimp die assembly 130. Some embodiments of a roll forming machine can be configured so that the shaft may move with the joint module as it moves relative to the frame. For example, the shaft support 116 may be slidably connected to the frame 102 so that the shaft 114 and the shaft support 116 can slide in a forward and backward longitudinal direction on the frame 102. The rails 142 of the joint module 126 may extend along the length of the frame 102 and be rigidly connected to the shaft support 116. The ridged connection between the rails 142 and the shaft support 116 effectively fixes the position of the shaft 114 relative to the carriage 132 so that the shaft 114 moves with the carriage 132 as they are moved by the carriage actuator 124 (see, e.g., FIG. 5). This may be useful, for example, so that a portion of the shaft 114 (and any features or parts positioned on the shaft 114) may remain within at least one of the pleat die assembly 128 and the crimp die assembly 130 as the joint module 126 is controlled to form joint segments from the roll formed tube.

Many alternative configurations for a movable shaft will be recognized by one of ordinary skill in the art, and such configurations are intended to be within the scope of the present application. For example, a roll forming machine can include a shaft actuator configured to selectively slide at least one of the shaft and the shaft support on the frame independently from the movement of the joint module.

As shown in FIGS. 1-4, 6 and 7, the crimp die assembly 130 may be positioned proximate the front side 144 of the carriage 132 and can be secured to the base 140 by at least one mounting structure 150 configured to be coupled to the upper surface of the base 140 and a side of the crimp die assembly 130. Referring now to FIGS. 13-16, the crimp die assembly 130 may include a support panel 152 with an aperture 154 extending between a front face and a rear face thereof. The aperture 154 is positioned so that, when the crimp die assembly 130 is mounted on the carriage 132, the shaft 114 of the roll forming machine 100 may extend through the aperture 154. A plurality of crimp die members 156 may be slidably secured to the rear face of the support panel 152 around the perimeter of the aperture 154. The crimp die members 156 may be operatively connected to a control ring 158 that is rotatably secured to the support panel 152 around the aperture 154 and the die members 156. Rotation of the control ring 158 in a first direction may force the crimp die members 156 to move radially inward into a contracted position, and rotation of the control ring 158 in a second direction may force the crimp die members 156 to move radially outward into an expanded position.

In the illustrated embodiments, for example, the upper and lower crimp dies members 156 each include a pin 160 that is received in a corresponding angled slot 162 formed in the control ring 158. The angled slots 162 are oriented so that rotation of the control ring 158 in a first direction (e.g., counterclockwise when facing the rear face of the support panel 152) forces the upper and lower die members 156 to move radially inward towards the aperture 154, while rotation of the control ring 158 in a second direction (e.g., clockwise when facing the rear face of the support panel 152) forces the upper and lower die members 156 to move radially outward away from the aperture 154. The left and right crimp die members 156 may be connected to at least one of the upper and lower crimp die members 156 by a slotted connection that causes the left and right die members 156 to move radially inward and outward with the upper and lower die members 156. Many alternative crimp die member movement configurations will be recognized by one of ordinary skill in the art, and such configurations are intended to be within the scope of the present application.

Figure 16:
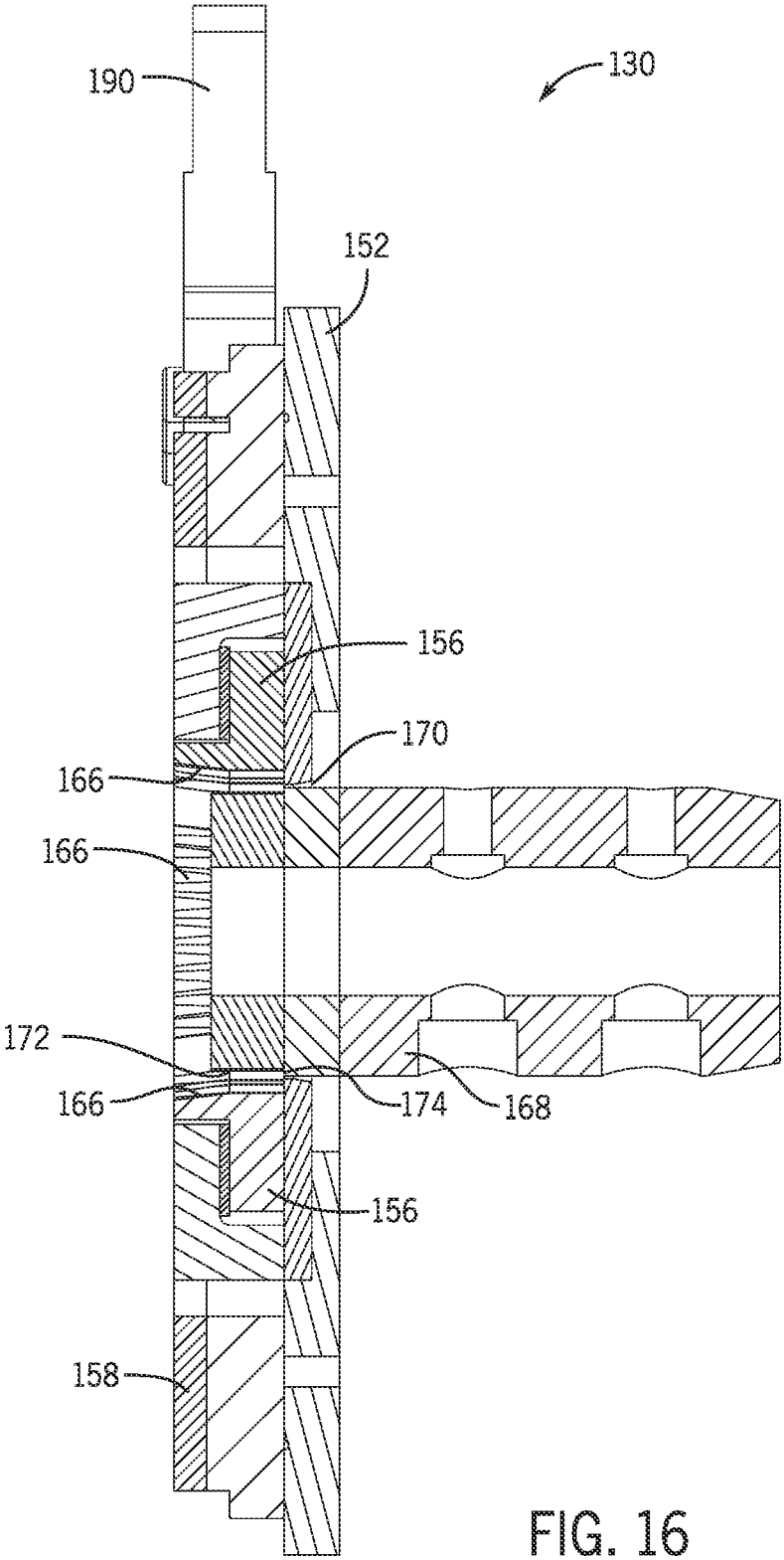
FIG. 16 is a top-down cross-sectional view of the crimp die assembly of FIG. 15.
Figure 17:
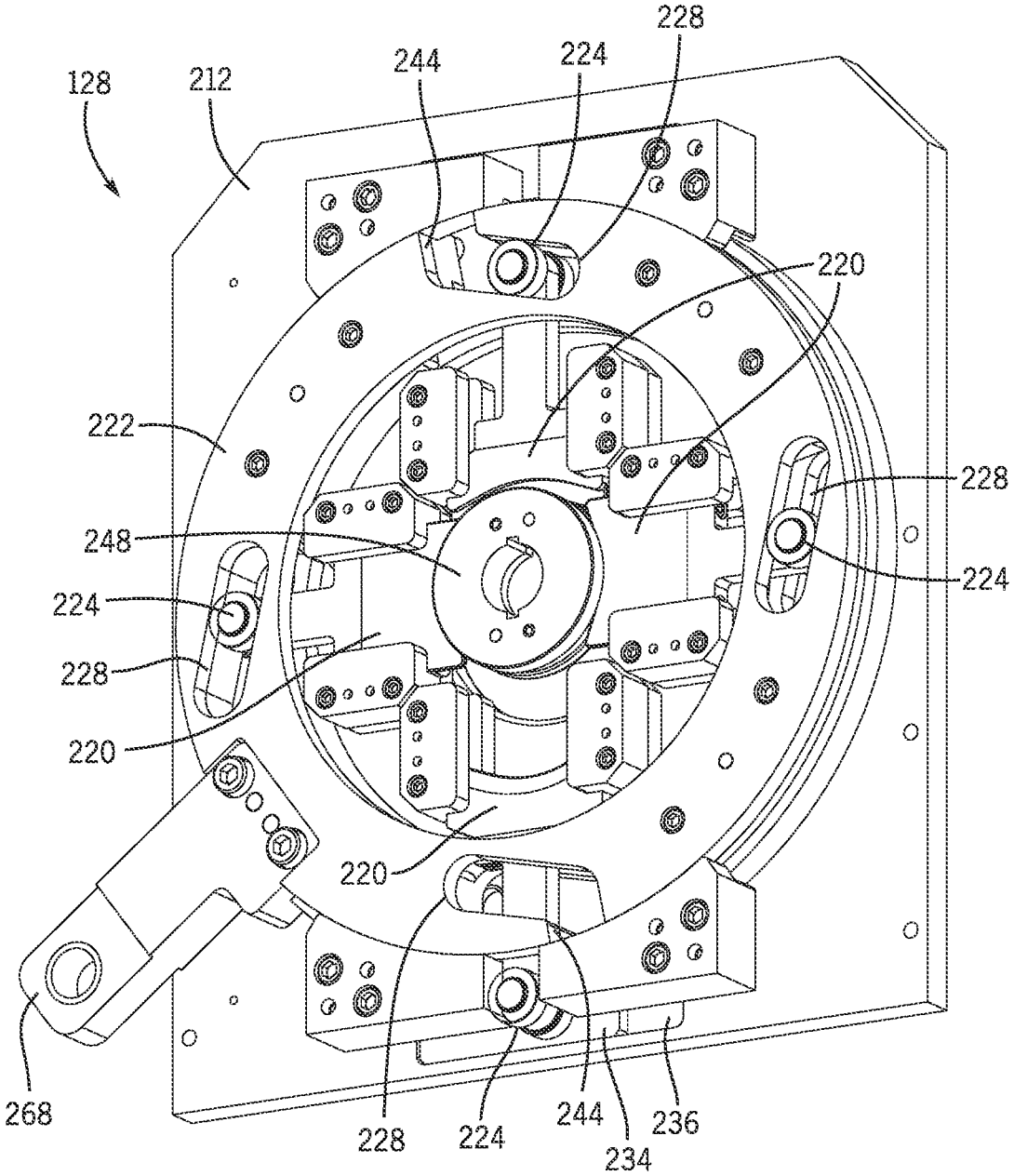
FIG. 17 is a perspective view of a pleat die assembly from the joint module of FIG. 12.
Figure 18:
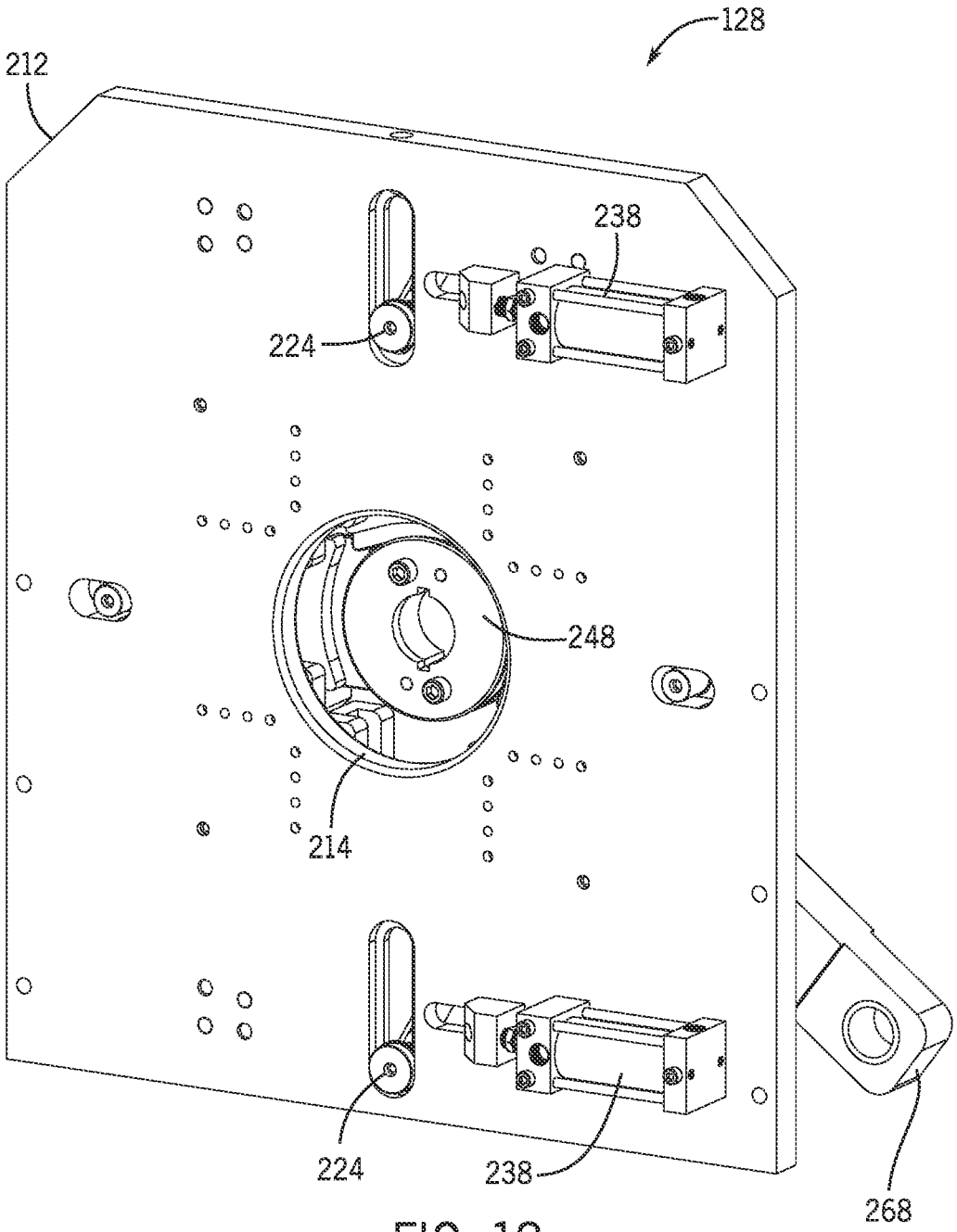
FIG. 18 is another perspective view of the pleat die assembly of FIG. 17.
Figure 19:
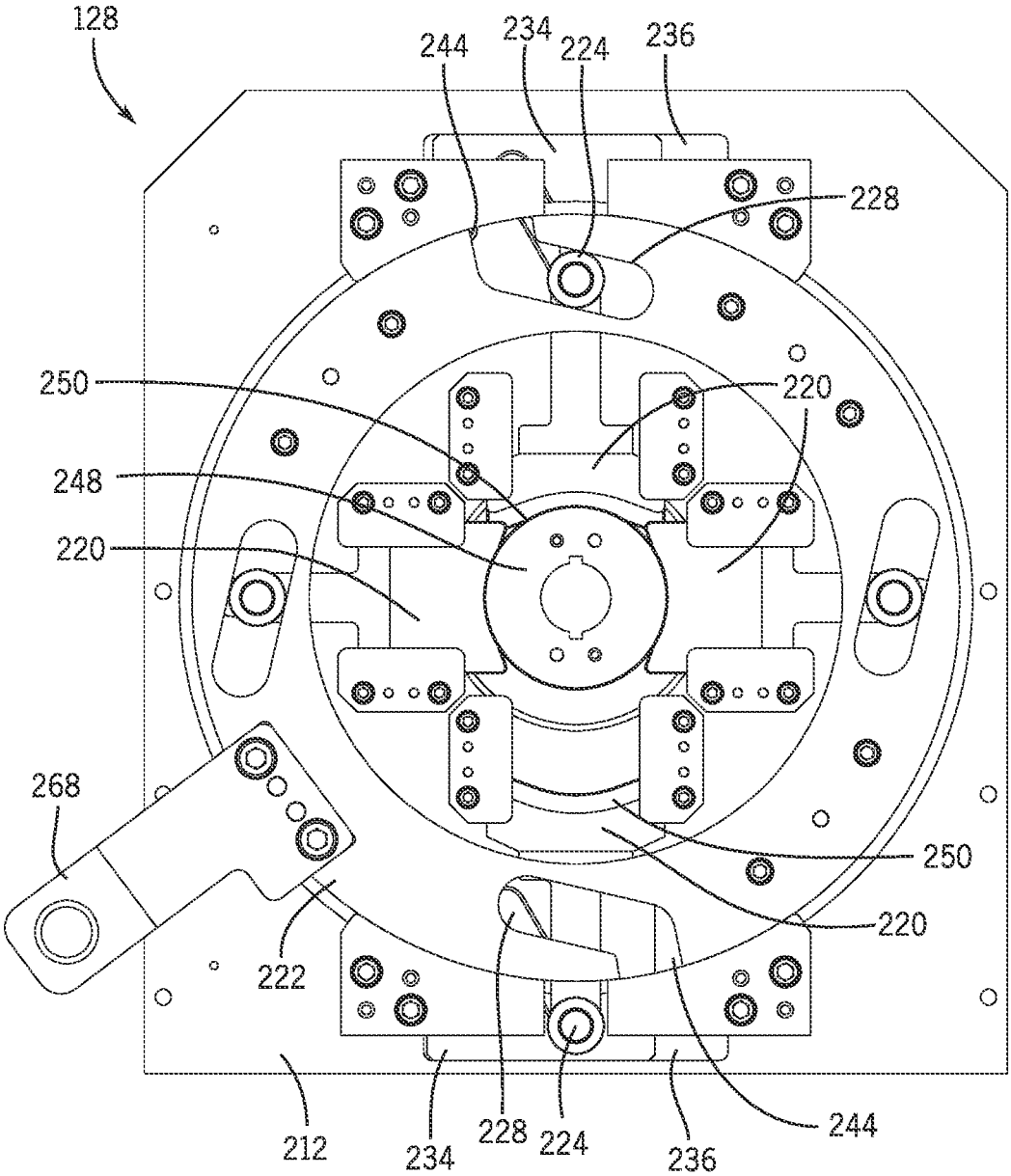
FIG. 19 is a rear view of the pleat die assembly of FIG. 18.

With continued reference to FIGS. 13-17, each crimp die member 156 may include an inwardly facing crimping face 166 that is generally arc shaped and includes a plurality of ridges extending longitudinally away from the rear surface of the support panel 152. A crimp die mandrel 168 may be configured to be secured to the shaft 114 so that the crimp die mandrel 168 is received within the aperture 154 of the support panel 152. As illustrated in FIG. 16, the crimp die mandrel 168 is dimensioned to leave a gap 170 between the outer surface of the mandrel 168 and the inner edge of the aperture 154 that is sufficiently large to allow the roll formed tube to pass through the aperture 154 in the gap 170. This may be useful, for example, to allow sections of the elongated tube to pass through the crimp die assembly 130 without performing a crimping operation. The mandrel 168 may include an outward facing crimping surface 172 that is recessed from the outer surface of the crimp die mandrel 168 and includes a plurality of longitudinal ridges corresponding to the ridges of the crimping faces 166 of the crimp die members 156. The illustrated crimp die mandrel 168 additionally includes a shearing surface 174 that extends radially between the outer surface and the mandrel crimping surface 172. When the crimp die mandrel 168 is in alignment with the crimp die assembly 130, the shearing surface 174 may be substantially planar with the rear face of the support panel 152, and the mandrel crimping surface 172 may be aligned with the crimp die members 156.

When the crimp die members 156 are in the expanded position, their crimping faces 166 are offset radially outward from the aperture 154 and the gap 170 between the mandrel 168 and the interior wall of the aperture 154 provides a ring-shaped passageway through the support panel 152 (see, e.g., FIG. 16). This may be useful, for example, so that roll formed tube may move through the crimp die assembly 130 by passing through the aperture 154 in the support panel 152 and the gap between the crimp die members 156 and the crimp die mandrel 168. As the crimp die members 156 are moved radially inward, the die crimping faces 166 moves past the edge of the aperture 154 so that the die members 156 at least partially cover the gap 170 and seal the passageway. In some embodiments, at least one of the crimp die members 156 may be configured to move far enough radially inward so that at least a portion of the crimp die piece 156 overlaps with the shear surface 174 of the crimp die mandrel 168, thereby completely sealing the corresponding side of the gap 170 when the crimp die members 156 are in the contracted position.

To control the movement of the crimp die members 156 between the contracted position and the expanded position, a joint module may include a crimping actuator configured to selectively rotate the crimp die assembly control ring. Referring now to FIGS. 6-12, for example, the joint module 126 may include a crimp actuator 180 that is mounted to a lower surface of the base 140 of the carriage 132 with a mounting bracket 182. The illustrated crimp actuator 180 is a servo actuator configured to selectively rotate an actuator shaft 184 that extends into the mounting bracket 182. Some embodiments, however, may be configured with a hydraulic actuator or any other type of actuator. The actuator shaft 184 is operatively connected to the control ring 158 by a bar linkage 186 that extends through a slot 188 formed in the base 140 to an arm 190 that extends radially outward from the control ring 158. To move the crimp die members 156 into the contracted position, the crimp actuator 180 can be controlled to rotate the actuator shaft 184 a first amount of rotation so that the arm 190 is pulled downward by the bar linkage 186, thereby rotating the control ring 158 in the first direction and moving the die members 156 radially inwardly. To return the crimp die members 156 to the expanded position, the crimp actuator 180 can be controlled to rotate the actuator shaft 184 a second amount of rotation so that the arm 190 is moved upwardly by the bar linkage 186, thereby rotating the control ring 158 in the second direction and moving the die members 156 radially outwardly.

In the illustrated embodiments, the crimp actuator 180 may be configured to actuate the crimp die members 156 by rotating the crimp actuator shaft 184 in a single direction. The bar linkage 186 may be connected to the actuator shaft 184 such that the actuator shaft 184 can be rotated 360 degrees, and the first amount of rotation and the second amount of rotation are both made in the same direction. In some embodiments, however, the crimp actuator 180 may be configured to actuate the crimp die members 156 by rotating the actuator shaft 184 in a reciprocating fashion. In such an embodiment, the first amount of rotation may be made in a first direction and the second amount of rotation may be made in a second direction opposite the first.

As previously mentioned, the crimp die assembly 130 can be used to cut and crimp an end of the elongated tube through selective movement of the crimp die members 156 between the expanded and contracted positions. When the crimp die members 156 move into the contracted position, the sides of the tube are pressed inward towards the outward facing mandrel crimping surface 172 by in crimping faces 166 of the crimp die members 156. The pressure exerted on the sides of the tube by the crimping faces 166 of the crimp die members 156 creates a shear force between the crimp die members 156 and the outermost surface of the crimp die mandrel 168 at the shear surface 174, thereby cutting the elongated tube at the shear surface 174 to create a free tube section that is separate from the elongated tube still connected to the sheet of material. Additionally, the inward movement of the crimp die members 156 may crimp the end of the free tube segment by compressing the tube segment wall to reduce the diameter of the free tube segment proximate its newly cut end. This may be useful, for example, so that the crimped end of one tube segment may fit within the diameter of an uncrimped end of another tube segment. After the tube has been cut and crimped with the crimp die assembly 130, the crimp die members 156 can be moved back to the expanded position so that another length of elongated tube can enter the crimp die assembly 130.

To perform cutting and crimping processes continuously without pausing the roll forming process, the carriage actuator 134 can be controlled to move the carriage 132 away from the back end 108 of the frame 102 at the same speed or a similar speed that the elongated tube is moving through the roller stations 104 when the crimp die members 156 are moved between the expanded and contracted positions. By generally matching the speed of the carriage 132 to the speed of the elongated tube, the crimp die assembly 130 can cleanly cut the elongated tube without distorting the ends of the tube segments while the elongated tube is continuously formed. In the illustrated embodiments, the rigid connection between the rails 142 of the joint module 126 and the shaft support 116 maintains alignment between the crimp die members 156 and the crimp die mandrel 168. In embodiments where the shaft is independently actuated, however, the shaft and/or shaft support may be controlled to slide towards the back end of the frame at the same rate as the carriage in order to maintain alignment. Once the crimp die members 156 have returned to the expanded position, the carriage may be retracted back towards the back end 108 of the frame 102 before cutting and crimping and additional tube segment.

Figure 6:
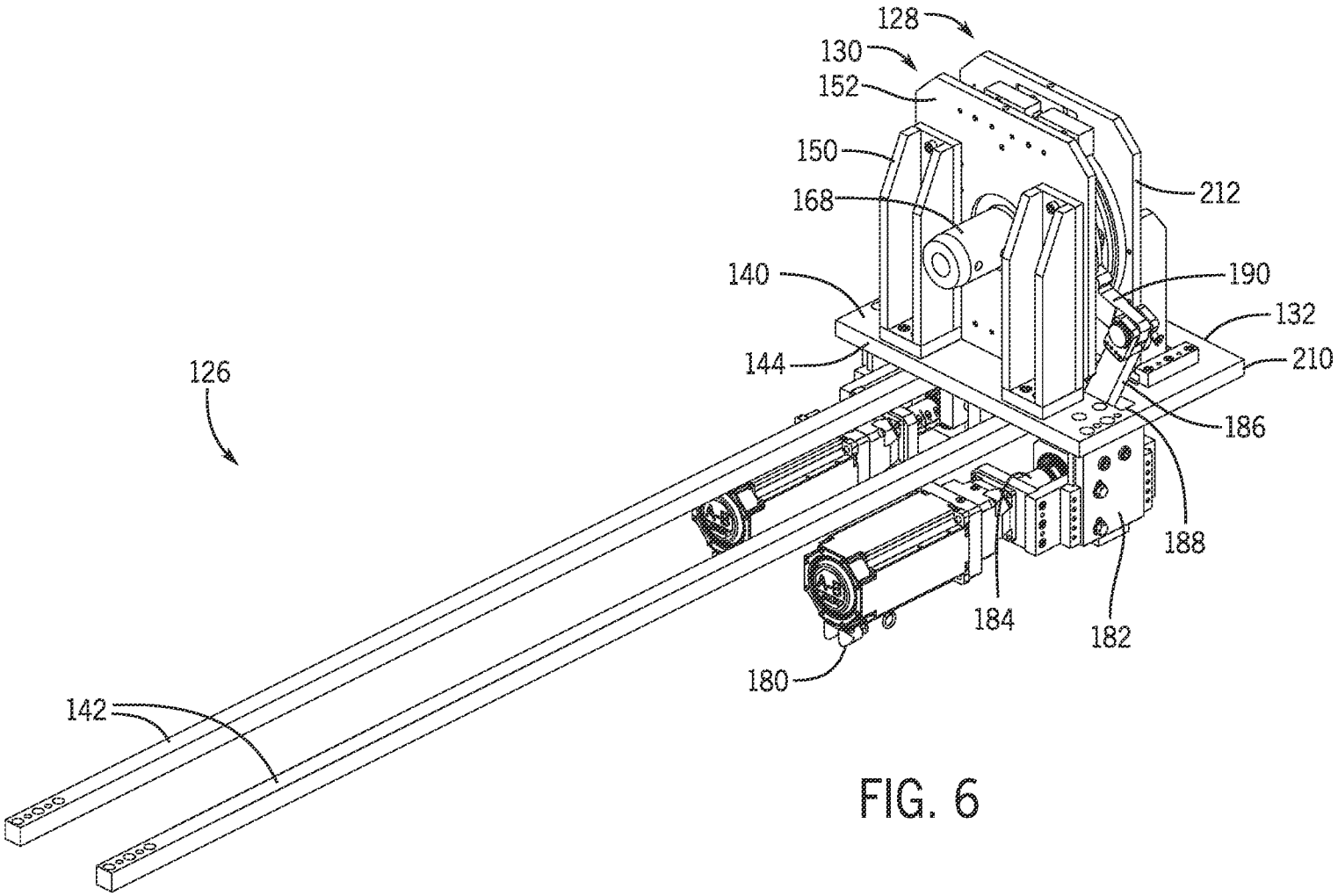
FIG. 6 is a perspective view of the joint module of FIG. 5.
Figure 7:
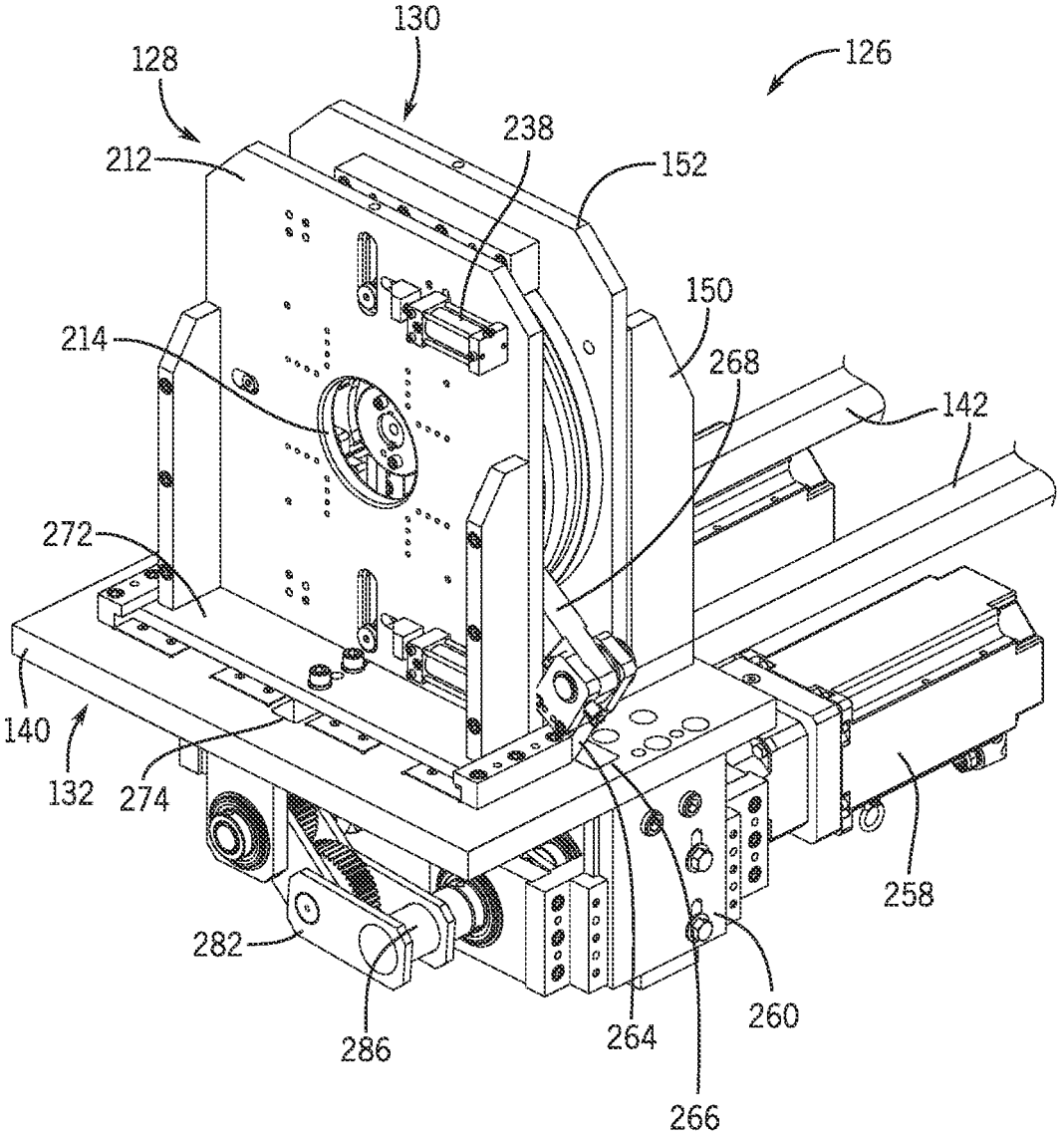
FIG. 7 is a detailed perspective view of the joint module of FIG. 6.
Figure 8:
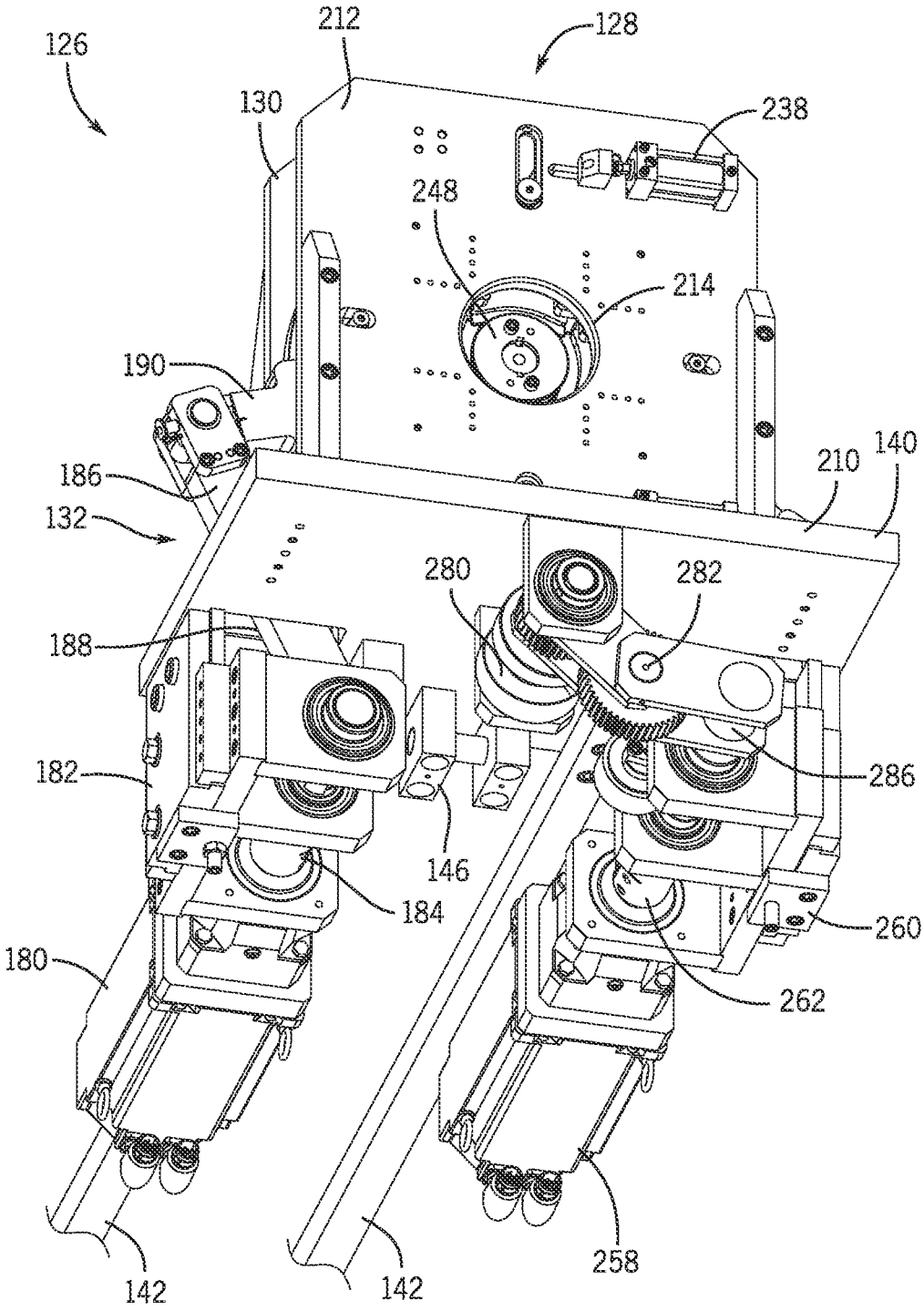
FIG. 8 is another detailed perspective view of the joint module of FIG. 7.
Figure 9:
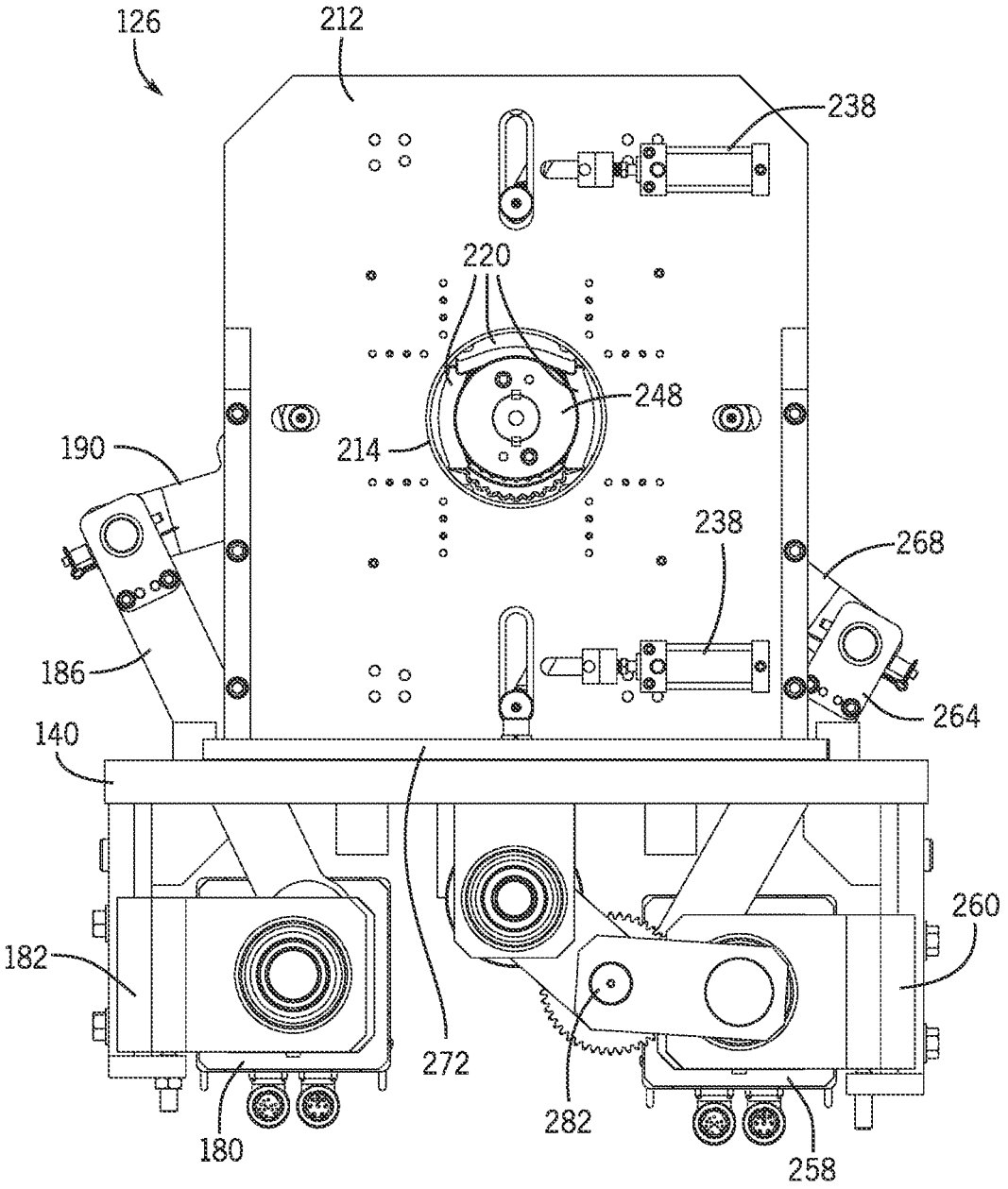
FIG. 9 is a front view of the joint module of FIG. 8.
Figure 10:
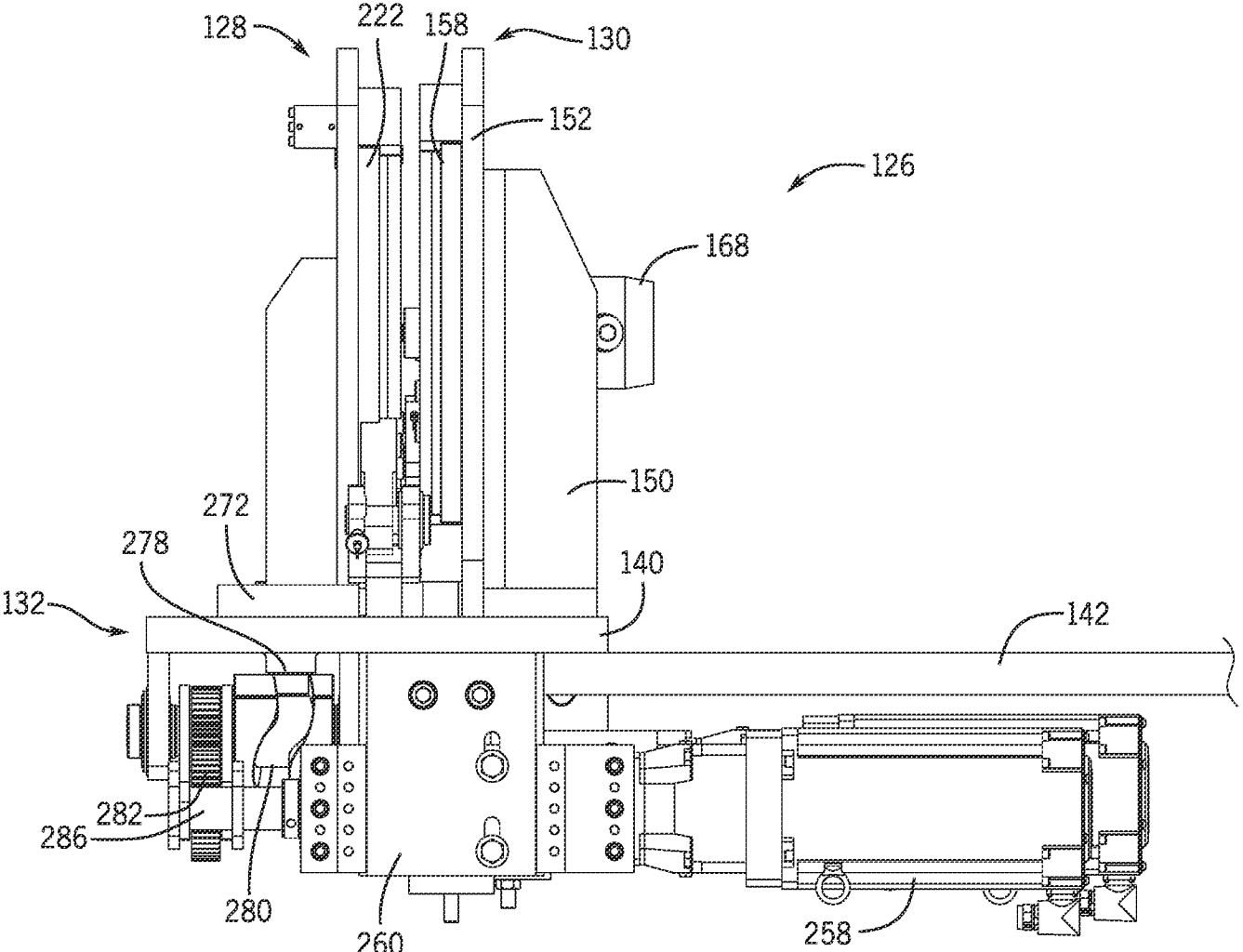
FIG. 10 is a side view of the joint module of FIG. 9.
Figure 11:
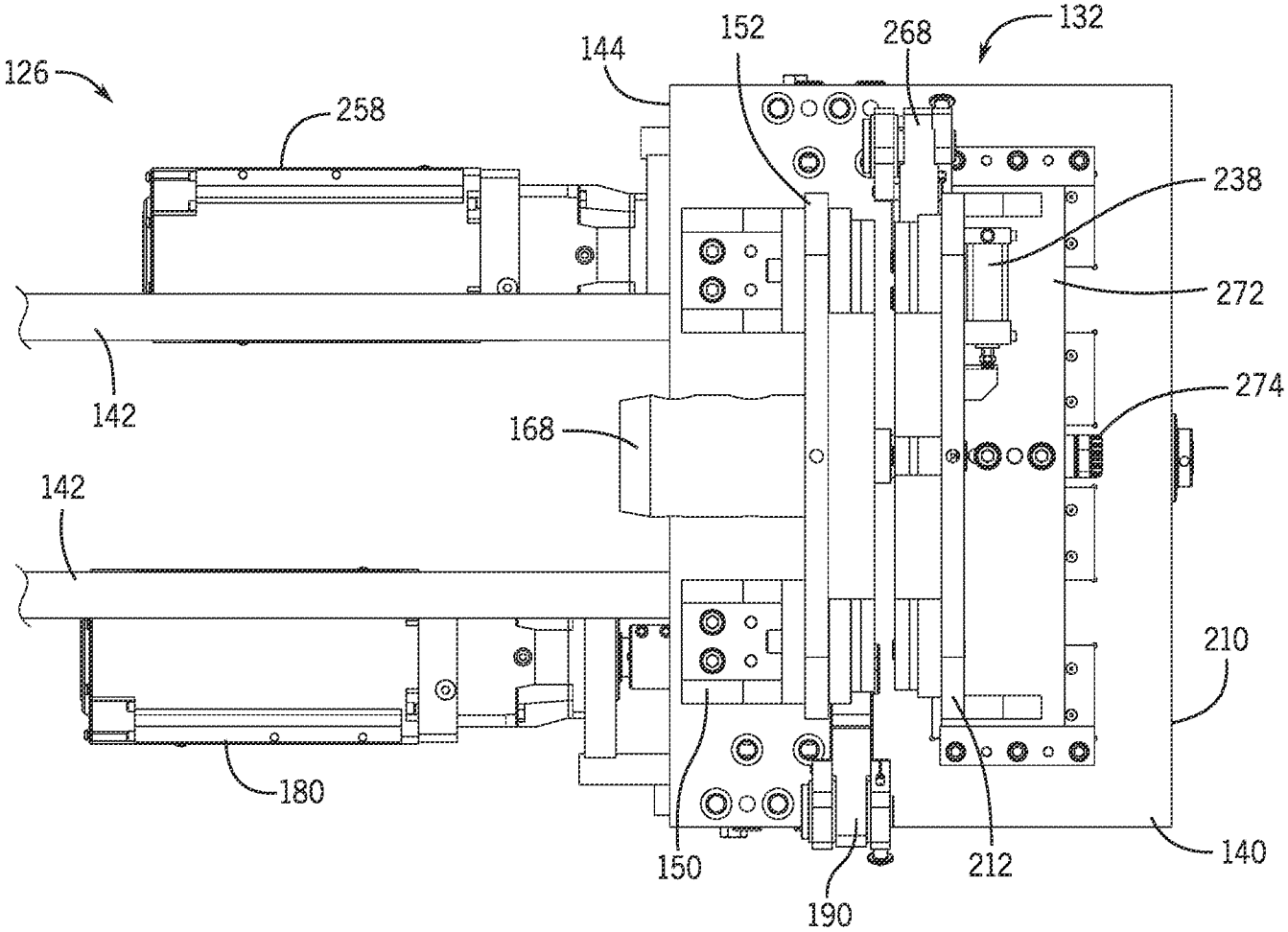
FIG. 11 is a top-down view of the joint module of FIG. 10.
Figure 12:
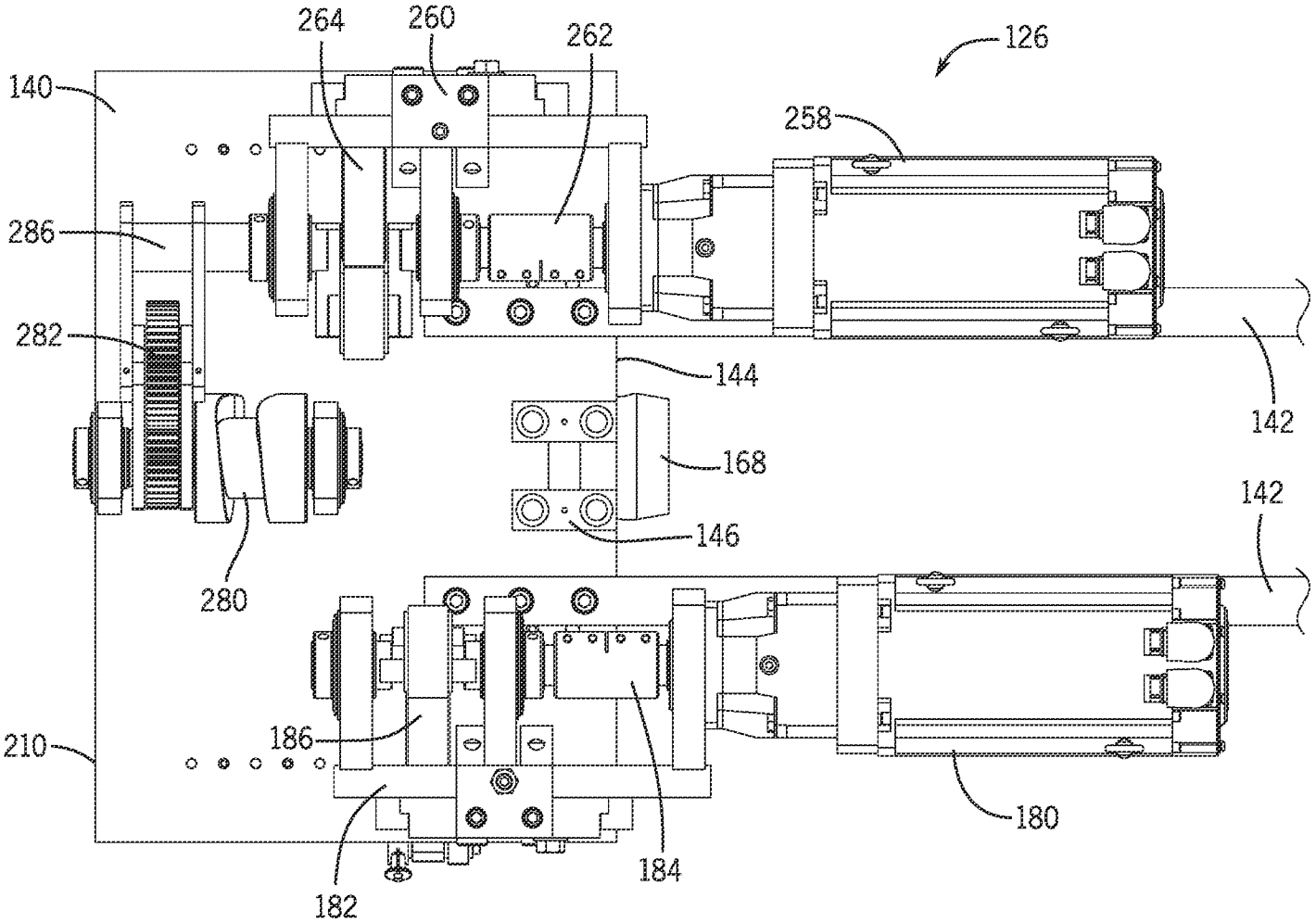
FIG. 12 is a bottom up view of the joint module of FIG. 11.
Figure 13:
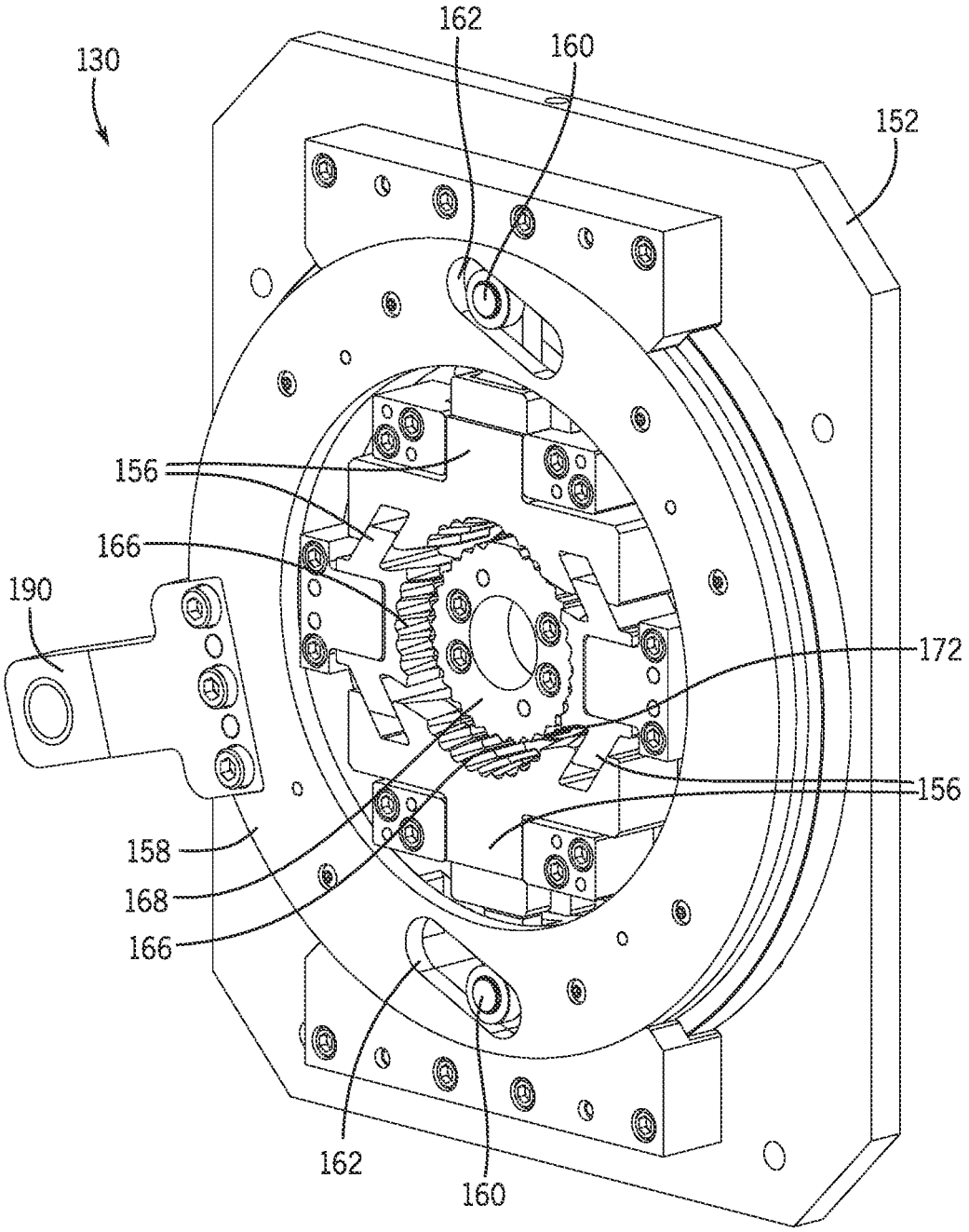
FIG. 13 is a perspective view of a crimp die assembly from the joint module of FIG. 12.
Figure 14:
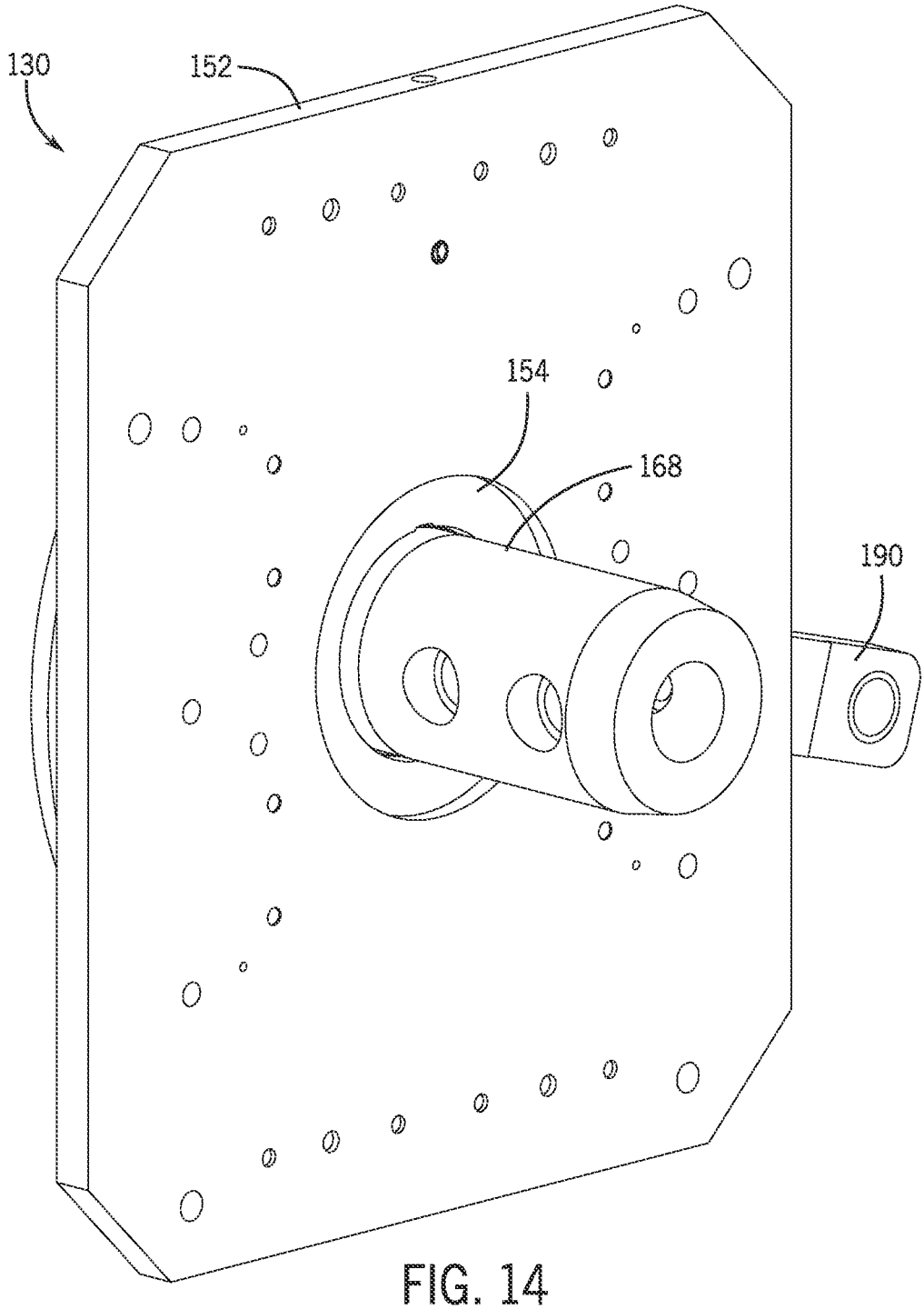
FIG. 14 is another perspective view of the crimp die assembly of FIG. 13.
Figure 15:
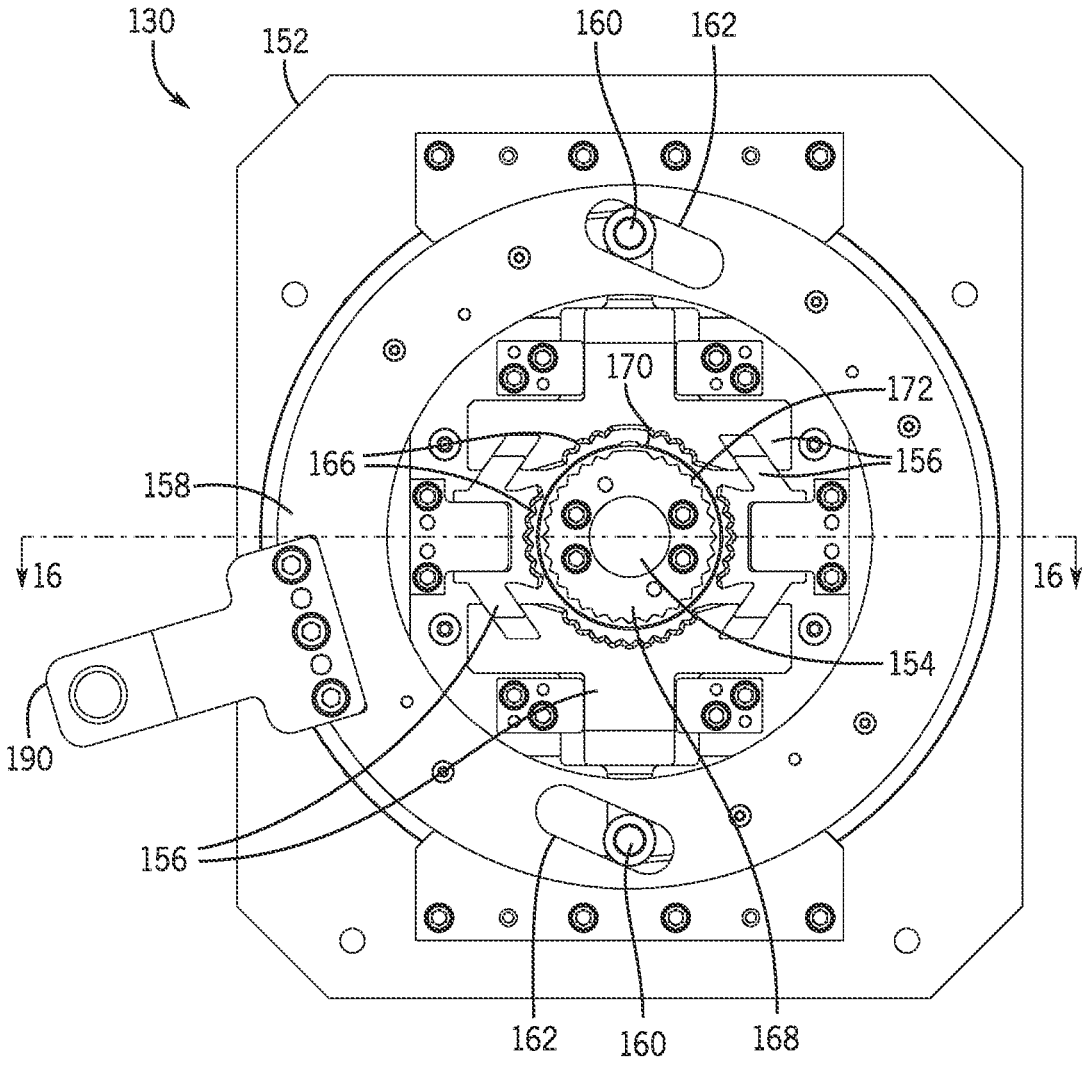
FIG. 15 is a front view of the crimp die assembly of FIG. 14.

With reference to FIG. 6, the pleat die assembly 128 may be positioned on the upper surface of the base 140 proximate the back side 210 of the carriage 132 so that the pleat die assembly 128 is positioned behind the crimp die assembly 130. Referring now to FIGS. 17-21, the pleat die assembly 128 may include a support panel 212 configured to be mounted on the carriage 132, and including an aperture 214 extending through the support panel 212 from a front face to a rear face thereof. The aperture 214 may be positioned within the support panel 212 so that it is concentric with the aperture 154 formed through the crimp die assembly support panel 152 while the pleat and crimp die assemblies 128, 130 are mounted on the carriage 132. This may be useful, for example, so that the shaft 114 and roll formed tubing that extends through the crimp die assembly 130 may subsequently extend into the passageway through the pleat die assembly.

A plurality of pleat die members 220 may be slidably secured to the front face of the support panel 212 around the perimeter of the aperture 214. The pleat die members 220 may be operatively connected to a control ring 222 that is rotatably secured to the support panel 212 around the aperture 214 and the die members 220. Rotation of the control ring 222 in a first direction may cause the pleat die members 220 to move radially inwardly into an extended position, and rotation of the control ring 222 in a second direction may cause the pleat die members 220 to move radially outwardly into a retracted position. In the illustrated embodiments, for example, each of the four pleat die members 220 may include a pin 224 position on an arm that extends outwardly from the body of each die member 220. Each of the pins 224 projects from the arm away from the support panel 212 and is received in a corresponding angled slot 228 formed in the control ring 222. The angled slots 228 are oriented so that rotation of the control ring 222 in a first direction (counterclockwise when facing the front face of the support panel 212) forces the pleat die members 220 to move radially inwardly towards the aperture 214, while rotation of the control ring 222 in a second direction (clockwise when facing the front face of the support panel 212) forces the pleat die members 220 to move radially outwardly away from the aperture 214. In some embodiments, at least one slot 228 formed in a control ring 222 may have a different shape. For example, a slot may have a curved (i.e., radiused) shape or any other geometric shape.

With continued reference to FIGS. 17-21, a pleat die mandrel 248 may be mounted on the shaft 114 so that the pleat die mandrel 248 is positioned in alignment with the pleat die members 220. Each of the pleat die members 220 may include a pleat extrusion 250 the extends radially inward from an inward-facing surface of the pleat die piece 220. The pleat extrusions 250 are generally arc-shaped and can be configured to be selectively received in a grove 254 formed around the outer surface of the pleat die mandrel 248. In the illustrated embodiments, the pleat die mandrel 248 and the pleat die members 220 are dimensioned to provide a gap between the pleat die mandrel 248 and the pleat extrusions 250 when the pleat die members 220 are in the retracted position. This may be useful, for example, so that roll formed tube may move through the pleat die assembly 128 by passing through the aperture 214 in the support panel 212 and the gap between the pleat die members 220 and the pleat die mandrel 248. When the pleat die members 220 are moved into the extended position by the control ring 222, the pleat extrusions 250 move radially inward into the grove 254 formed around the pleat die mandrel 248, thereby closing the passageway through the pleat die assembly 128. If a portion of the roll formed tube is positioned between the pleat die members 220 and the pleat die mandrel 248 as the pleat die members 220 moves into the extended position, the wall of the tube may be deformed as the wall is pressed into grove 254 by the pleat extrusions 250. This may cause the deformed portion of the wall to fold over itself, thereby forming a pleat in the wall of the elongated tube.

To control the movement of the pleat die members 220 between the extended position and the retracted position, a joint module may include a pleat actuator configured to selectively rotate the pleat die assembly control ring. Referring to FIGS. 6-12, for example, the joint module 126 may include a pleat actuator 258 that is mounted to a lower surface of the base 140 of the carriage 132 with a mounting bracket 260. The illustrated pleat actuator 258 is configured as a servo actuator configured to selectively rotate an actuator shaft 262 that extends into the mounting bracket 260. Some embodiments, however, may be configured with a hydraulic actuator or any other type of actuator. The actuator shaft 262 is operatively connected to the control ring 222 by a bar linkage 264 that extends through a slot 266 formed in the base 140 to an arm 268 that extends radially outward from the control ring 222. To move the pleat die members 220 into the extended position, the pleat actuator 258 can be controlled to rotate the actuator shaft 262 a first amount of rotation so that the arm 268 is pulled downwardly by the bar linkage 264, thereby rotating the control ring 222 in the first direction and moving the die members 220 radially inwardly. To return the pleat die members 220 to the retracted position, the pleat actuator 258 can be controlled to rotate the actuator shaft 262 a second amount of rotation so that the arm 268 is moved upwardly by the bar linkage 264, thereby rotating the control ring 222 in the second direction and moving the die members 220 radially outwardly.

In the illustrated embodiments, the pleat actuator 258 may be configured to actuate the pleat die members 220 by rotating the pleat actuator shaft 262 in a single direction. The bar linkage 264 may be connected to the actuator shaft 262 such that the actuator shaft 262 can be rotated 360 degrees, and the first amount of rotation and the second amount of rotation are both made in the same direction. In some embodiments, however, the pleat actuator 258 may be configured to actuate the pleat die members 220 by rotating the actuator shaft 262 in a reciprocating fashion. In such an embodiment, the first amount of rotation may be made in a first direction and the second amount of rotation may be made in a second direction opposite the first.

Figure 20:
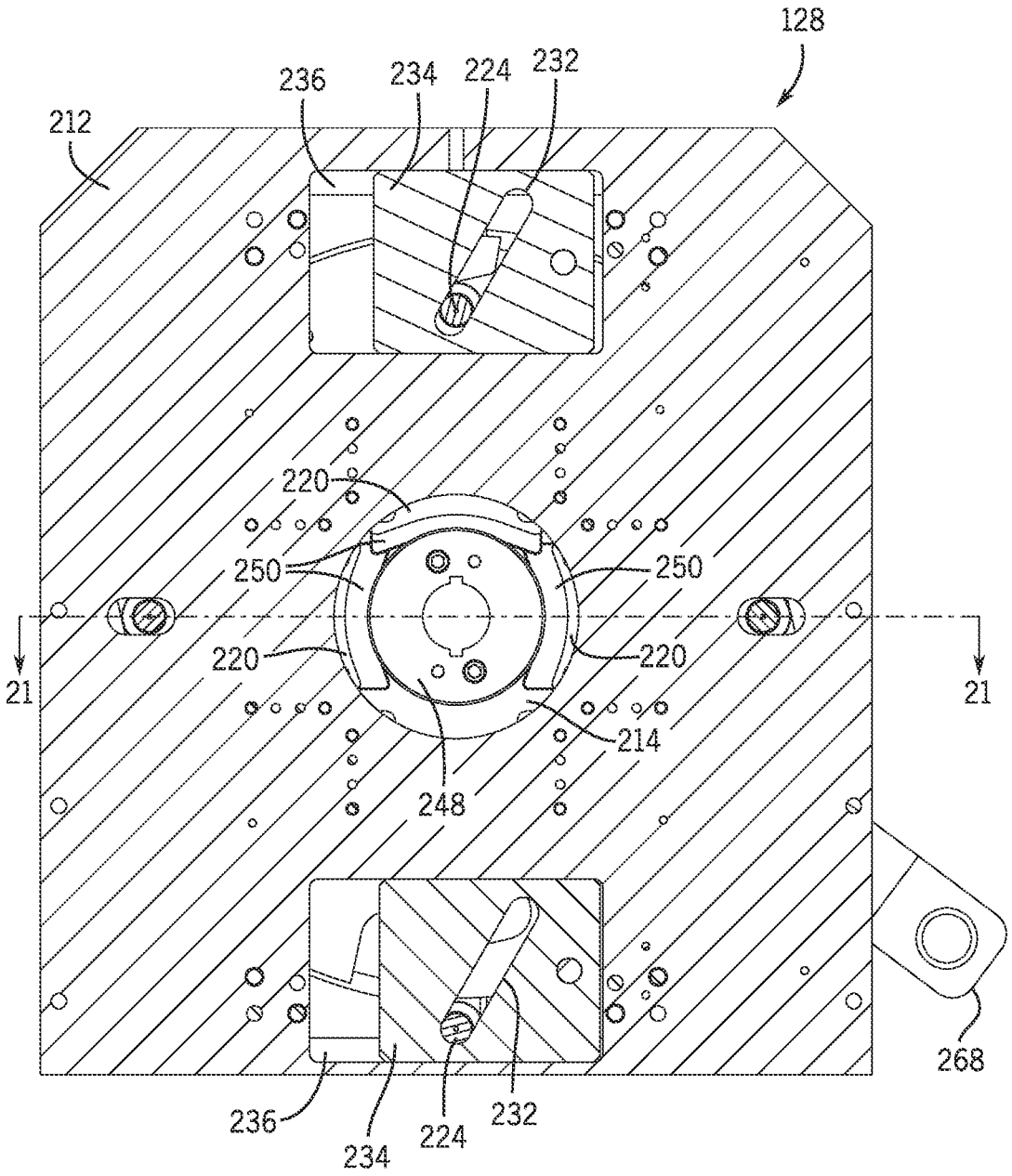
FIG. 20 is a front cross-sectional view of the pleat die assembly of FIG. 19.
Figure 21:
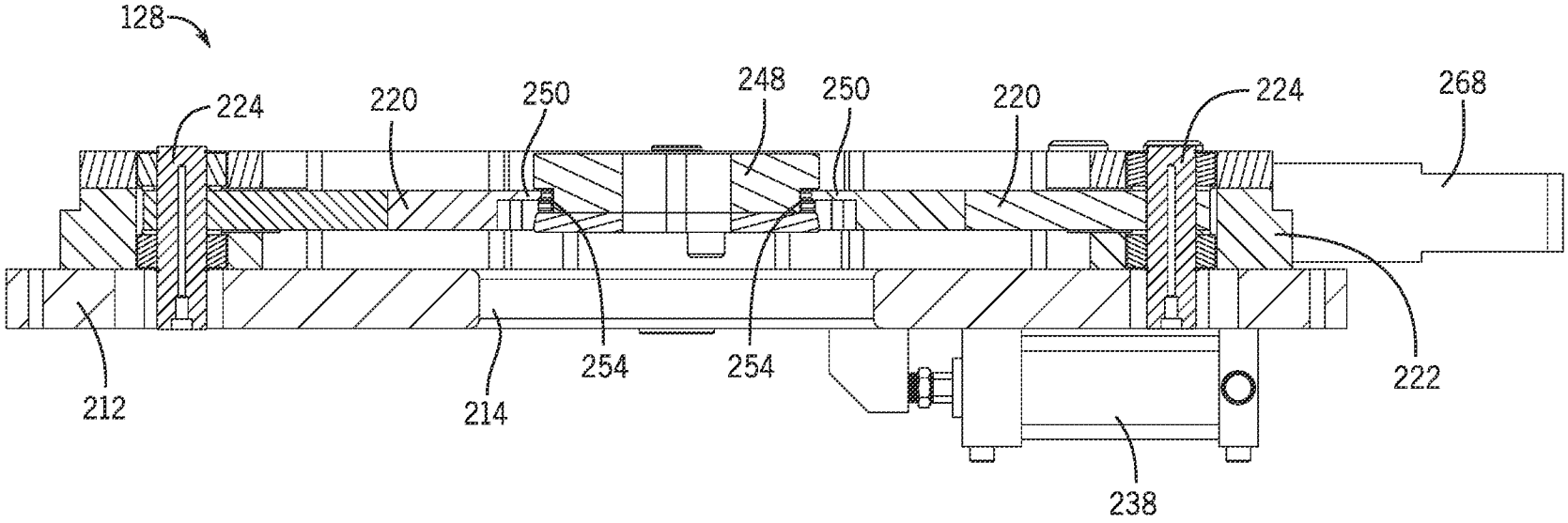
FIG. 21 is a top-down cross-sectional view of the pleat die assembly of FIG. 20.
Figure 22:
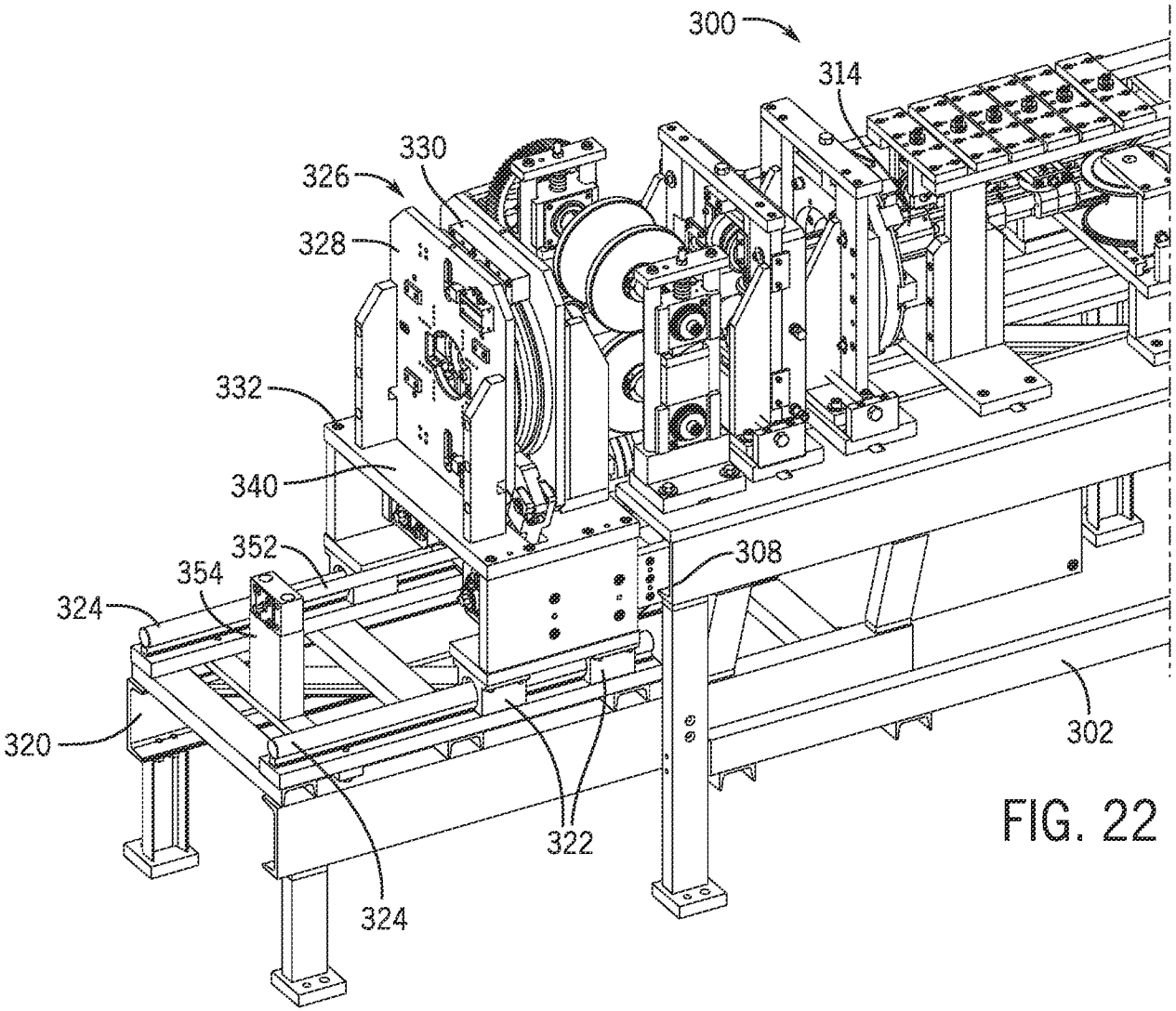
FIG. 22 is a perspective view of another embodiment of a roll forming machine with a joint module.

In some embodiments, a pleat die assembly may include a direction control system configured to selectively prevent at least one of the pleat die members 220 from being moved by the control ring 222. In the illustrated embodiments, for example, the upper and lower pleat die members 220 may be selectively disengaged from the control ring 222. In addition to engaging an angled slot 228 in the control ring 222, the pins 224 of upper and lower pleat die members 220 each extend towards the support panel 212 to engage a second angled slot 232 formed in a corresponding selector plate 234 that is slidably received in a recess 236 formed in the front face of the support panel 212. As illustrated in FIG. 20, the selector plates 234 can slide laterally within the respective recess 236. Pleat engagement actuators 238 secured to a rear face of the support panel 212 and are connected to one of the selector plates 234 through a lateral slot formed through the support panel 212. The engagement actuators 238 may be configured to independently move plate 234 within the respective recess 236 to disengage one of the pleat die members 220. When an engagement actuator 238 is controlled to move a plate 234 in a first direction, the interface between the angled slot 232 in the selector plate 234 and the pin 224 forces the corresponding pleat die member 220 to move into a disengaged position by moving the pin 224 radially outwardly and out of the control ring 222 through a notch 244 formed in the side of the control ring 222. While a pleat die member 220 is in a disengaged position, the control ring 222 can be rotated without moving the disengaged die member 220. Thus, an elongated tube received in the pleat die assembly 128 may not be pleated on the side of the tube corresponding to a disengages pleat die member 220. To move the pleat die member 220 back into an engaged position, the selector actuator 238 can be controlled to move the selector plate 234 in a second lateral direction opposite the first direction to force the pin 224 to move back into the corresponding angled slot 228 in the control ring 222 through the notch 244.

As previously discussed, the pleat die assembly 128 may be configured to bend the elongated tube to form a joint section. In some embodiments, the bend may be produced by repeatedly pleating the wall of the elongated tubes on three of four sides at regular intervals along the length of the tube. In the illustrated embodiments, for example, the elongated tube may be bent upwards or downwards by actuating the control ring 222 to extend the pleat die members 220 while the lower pleat die member 220 or the upper pleat die member 220, respectively, is disengaged from the control ring 222. When a side of the elongated tube is pressed between the pleat extrusion 250 of a pleat die member 220 and the grove 254 of the pleat die mandrel 248, the engaged portion of the tube wall is deformed to form a pleat, thereby reducing the overall length of the pleated side of the tube. Asymmetrical pleating of a tube (i.e., pleating on three sides) results in the tube bending away from the unpleated side of the tube, which does not change in length. Each asymmetrical pleat may result in only a relatively small bend in the elongated tube, so, in some embodiments, the tube may be repeatedly pleated at regular intervals along its length until the desired bend angle is obtained. Other embodiments, however, may be configured with an adjustable pleat die assembly that may be adjusted to increase or decrease the bend angle formed by each pleat in the elongated tube.

Traditional bending mechanisms for roll forming machines obtain the desired pleat spacing by stopping the roll forming process to perform a pleat, then restarting the roll forming process to advance the elongated feature the desired distance before pausing again to form a subsequent pleat. The illustrated roll forming machine 100, in contrast, may be configured to perform pleating operations without stopping or reducing the speed of the roll forming process. In some embodiments, the carriage actuator 134 can be configured to move the carriage 132 away from the back end 108 of the frame 102 at the same speed that the elongated tube is moving through the roller stations 104 while the pleat die members 220 are moved between the extended and retracted positions to form a pleat in the elongated tube. After a pleat is formed, the carriage actuator 134 can be controlled to briefly stop or decrease the movement speed of the carriage 132 so that the elongated tube may advance through the pleat die assembly 128 to the location of the next pleat.

Additionally, or alternatively, a joint module can include a movable pleat die assembly that is configured to slide laterally on the carriage. As illustrated in FIGS. 7-12, for example, the pleat die assembly 128 may be mounted on a slide 272 that is secured to the upper surface of the base 140 of the carriage 132 through a sliding interface. The slide 272 is positioned above a longitudinal slot 274 formed through the base 140, and a follower pin 278 secured to the bottom of the slide 272 may extend downward through the longitudinal slot 274 to engage a cam 280 mounted on the lower surface of the carriage 132. The cam 280 and follower pin 278 may be configured so that rotation of the cam 280 causes the pleat assembly 128 to slide forwards and backwards along the longitudinal direction. This may be useful, for example, so that the pleat die assembly 128 can be moved forward to maintain its position relative to the elongated tube while the pleat die members 220 are moved between the extended and retracted positions. Additionally or alternatively, the cam 280 can be configured to move the pleat die assembly 128 towards the front side of the carriage 132 as the pleat die members 220 are moved into the extended position, thereby causing the elongated tube to be pushed into the pleat die members 220 while they are engaged with the sides of the elongated tube. This may be useful to help fold the deformed portions of the tube wall to create the pleat.

To link the sliding movement of a pleat die assembly 128 to the actuation of the pleat die members 220, the cam 280 may be mechanically linked to the pleat actuator 258. As illustrated in FIGS. 1-12, for example, a linkage assembly 282 may be connected to the cam 280 and may operatively connect the cam 280 to the actuator shaft 262. As the pleat actuator 258 rotates the actuator shaft 262 to move the pleat die members 220 into the extended position, the linkage assembly 282 may substantially simultaneously rotate the cam 280 a first amount of rotation, thereby sliding the slide 272 and the pleat die assembly 128 in a first longitudinal direction (e.g., towards the front of the joint module 126). As the pleat actuator 258 rotates the actuator shaft 262 to move the pleat die members 220 back to the retracted position, the linkage assembly 282 may rotate the cam 280 a second amount of rotation to move the slide 272 and the pleat die assembly 128 in a second longitudinal direction and back to the starting position. In the illustrated embodiments, the pleat actuator 258 and the cam 280 may be configured so that the first amount of rotation, and the second amount of rotation of the cam 280 are both made in the same direction. Additionally or alternatively, the pleat actuator 258 can be configured to rotate the cam 280 in a reciprocating manner such that the first amount of rotation is made in a first direction and the second amount of rotation is made in a second direction opposite the first direction.

In some embodiments, the actuator shaft may include a section (not shown) that extends though the mounting bracket 260 to engage the linkage assembly 282. Other embodiments may include a shaft extension 286 or any other mechanical linkage that connects the actuator shaft 262 to the linkage assembly 282. Further still, a joint module may include a cam that is rotated independently, or the pleat die assembly may be moved by a different actuation mechanism and/or a separate cam actuator. In the illustrated embodiments, the cam 280 is configured as a barrel cam connected to a shaft 262 of the pleat actuator 258. Other embodiments, however, may include alternative mechanisms for moving the pleat die assembly on the carriage 132. For example, a pleat actuator may be linked to the slide via a different type of cam and/or through any other type of linkage.

To form a tubular joint section using the roll forming machine 100, sheet metal may be fed into the roller stations 104 on the frame 102, which may gradually bend the sheet into a hollow, elongated tube. The illustrated roll forming machine 100 is configured to form a circular tube. However, some roll forming machines may be configured to form differently shaped tube, such as an ellipsoid or rectangular tube. As the roll forming machine 100 continues to receive additional lengths of sheet metal, the roll formed tube is extruded from the roller stations 104 proximate the back end 108 of the frame 102 and may travel into the joint module 126, first passing through the crimp die assembly 130 then moving through the pleat die assembly 128. After a predetermined length of elongated tube has moved through the pleat die assembly 128, exiting through the aperture 214 on the support panel 212, the carriage actuator 134 can be controlled to begin moving the carriage 132 away from the back end 108 of the frame 102. The carriage actuator 134 can match the speed of the elongated tube so that the crimp and pleat die assemblies 128, 130 move with the tube, slightly faster than the tube, or slightly slower than the tube based on the required speed to achieve the desired pleat, crimp and/or cut.

Once the carriage 132 begins moving with the elongated tube, the pleat die assembly 128 can be controlled to bend the tube with a plurality of pleats. To bend the tube upwardly, the pleat direction selector system can be controlled to move the lower pleat die member 220 into the disengaged position before the pleat actuator 258 is controlled to move the lateral and upper pleat die members 220 into the extended position by rotating the pleat control ring 222. As the pleat die members 220 engage and deform the upper and lateral sides of the elongated tube, the cam 280 may be rotated to simultaneously slide the pleat die assembly 128 towards the front of the carriage 132. The sliding movement of the pleat die members 220 while they are engaged with the deforming portions of the tube wall causes the deformed portions to be folded over an adjacent part of the tube wall thereby forming a pleat. The formation of a pleat around the upper and lateral sides on the elongated tube causes the tube to bend upwardly away from the base 140 of the carriage 132. After the pleat is formed, the pleat actuator 258 is controlled to return the pleat die members 220 to the retracted position, and the cam 280 is rotated to move the pleat die assembly 128 back towards the rear of the carriage 132. The carriage actuator 134 may then be controlled to adjust movement speed of the carriage 132 to allow the elongated tube to progress a predetermined distance through the joint module 126 before re-matching the speed of the elongated tube. The pleating process can then be repeated to produce additional pleats along the length of the elongated tube, thereby increasing the bend angle of the joint section.

After the desired bend angle has been achieved, the joint section can be severed from the elongated tube by the crimp die assembly 130. Once the crimp die assembly 130 is aligned with a desired endpoint for the joint section, the crimp actuator 180 may be controlled to move the crimp die members 156 from the expanded position to the contracted position while the carriage 134 generally matches the speed of the carriage 132 to the speed of the elongated tube. As they engage the sides of the tube, the crimp die members 156 may shearingly cut the tube walls against the shear surface 174 of the crimp die mandrel 168. As the joint section is cut away from the elongated tube, the end of the joint section is pressed against the mandrel crimping surface 172 by the crimping faces of the crimp die members 156. The force applied by the crimp die members 156 may cause the diameter of the end of the joint section to decrease while a ridged corrugation pattern is formed by the corresponding ridges on the crimp die members 156 and the crimp die mandrel 168. After the end of the joint section has been crimped and severed from the elongated tube, the crimp actuator 180 can be controlled to return the crimp die members 156 to the expanded position so that the completed joint section may be removed from the joint module 126. The carriage actuator 134 may then be controlled to move the carriage 132 back towards the frame 102 so that another joint section may be formed.

Some embodiments of a roll forming machine may include a differently configured joint module. As illustrated in FIGS. 22-27, for example, a roll forming machine 300 may include a joint module 326 with a pleat die assembly 328 and a crimp die assembly 330 that are rigidly connected to the base 340 of the carriage 332. The joint module 326 is slidably supported on a joint module support frame 320. Sliding support members 322 positioned on the bottom of the carriage 332 are configured to engage support rails 324 that extend longitudinally along opposite sides of joint module support frame 320. In some embodiments, the joint module support frame 320 is coupled to the frame 302 of the roll forming machine 300 (see, for example, FIG. 22), while other embodiments may include a freestanding joint module support frame 320 that is not connected to the frame of the roll forming machine 302 (see, for example, FIG. 25).

Figure 25:
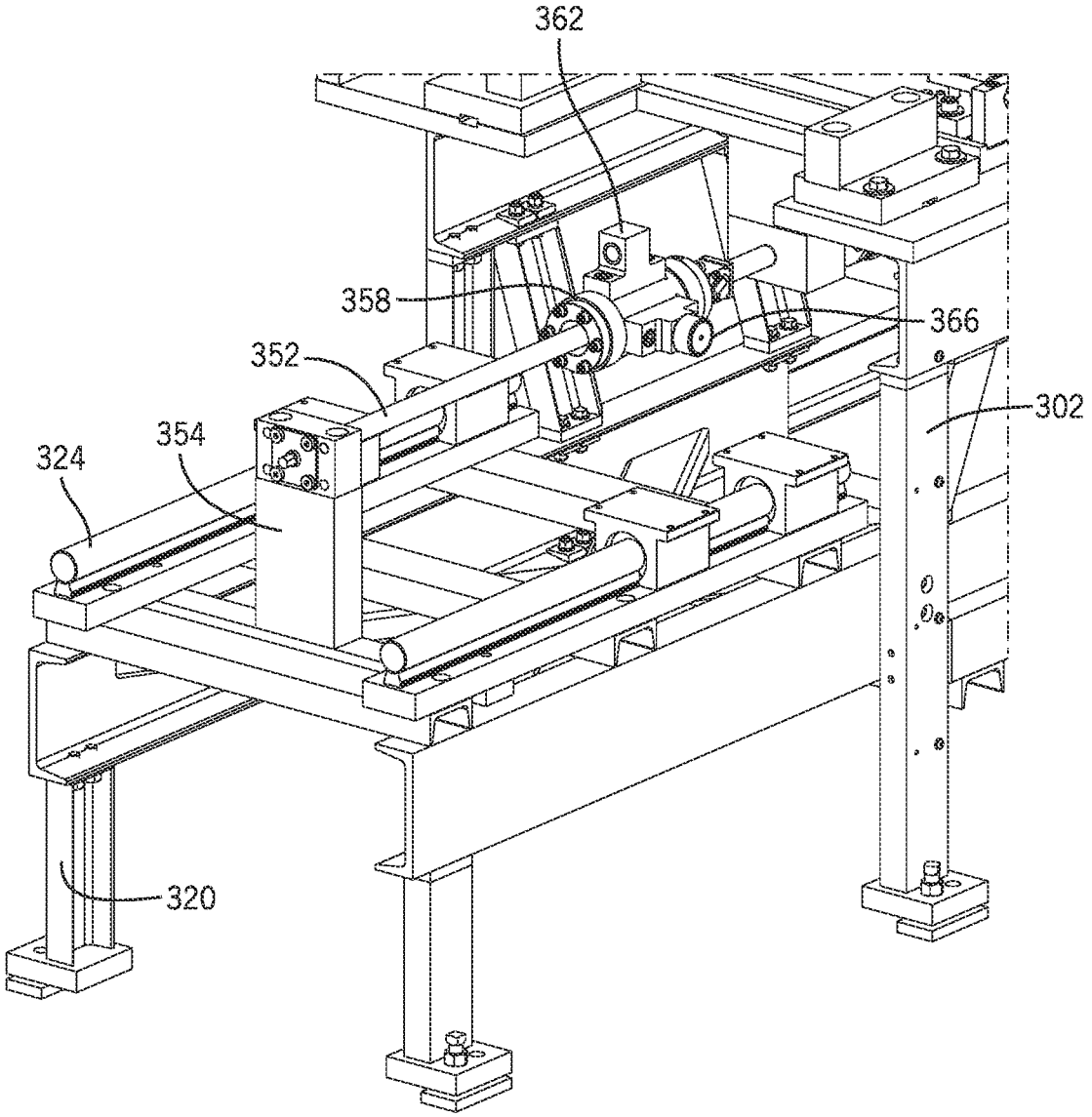
FIG. 25 is a detailed perspective view of the roll forming machine and joint module support frame of FIG. 22.
Figure 26:
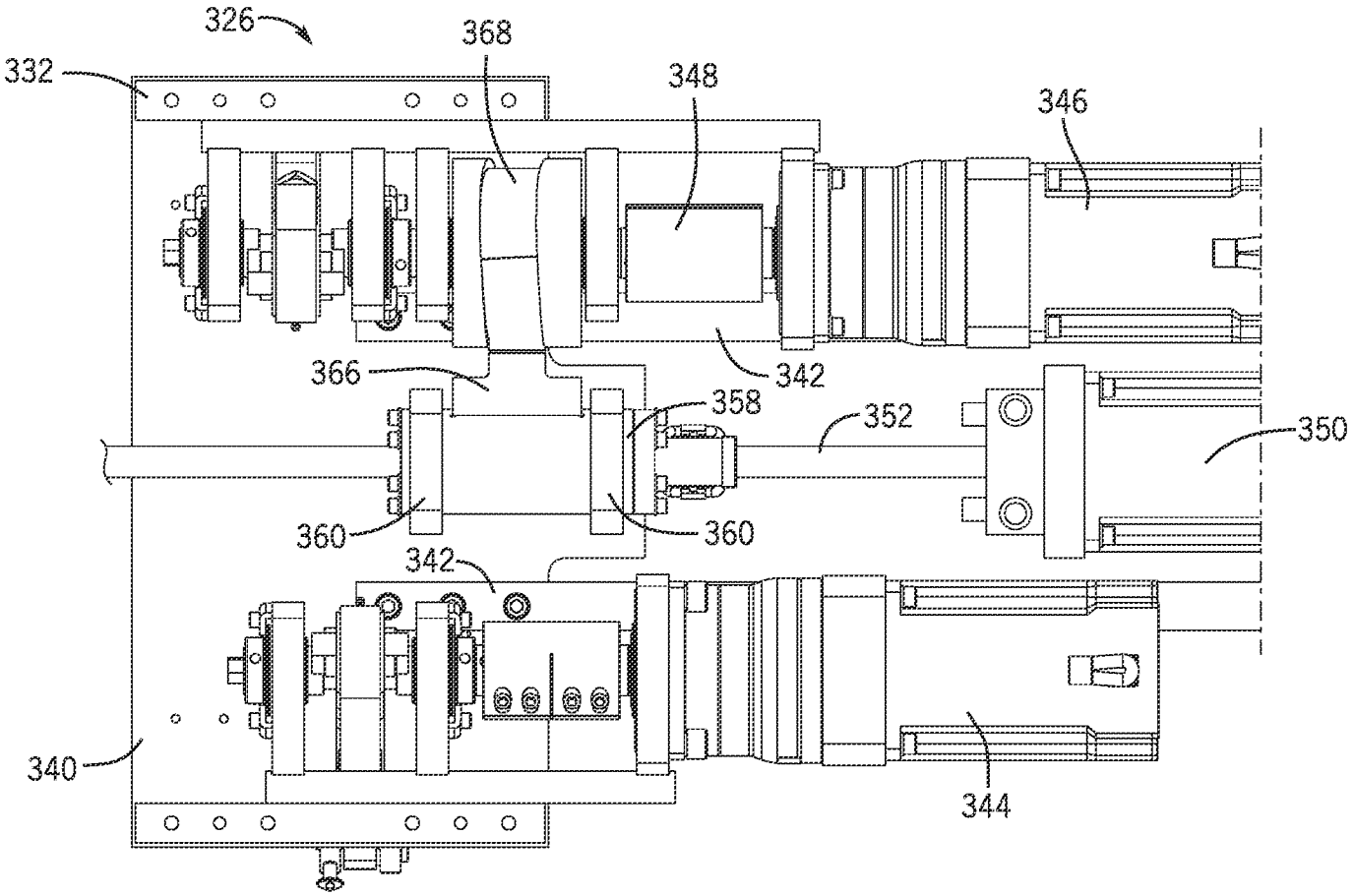
FIG. 26 is a bottom-up cross-sectional view of the joint module on the joint module frame of FIG. 22.

Movement of the joint module 326 towards and away from the back end 308 of frame 302 of the roll forming machine 300 may be selectively controlled by a carriage actuator 350 mounted on the frame 302. Referring to FIG. 25, the carriage actuator, which may be positioned on the frame 302, is configured to selectively rotate a threaded rod 352 that extends along the joint module support frame 320 to a far-side support 354. A positioning sleeve 358 is received on the threaded rod 352 and is configured to be threadedly engaged with the threaded rod 352. As illustrated in FIG. 26, the positioning sleeve 358 is configured to be received by at least one coupling bracket 360 positioned on the bottom of the base 340 of the carriage 332 of the joint module 326. Engagement between a positioning member 362 on the positioning sleeve 358 and a pin (not shown) extending through the coupling bracket 360 may restrict rotational motion of the positioning sleeve 358 relative to the threaded rod 352. The positioning sleeve 358 may further include a follower pin 366 that projects laterally outward from a side of the positioning sleeve 358. The follower pin 366 is configured to engage a cam 368, which is mounted on the shaft 348 of the pleat actuator 346 so that the cam 368 rotates with the shaft 348 as the pleat actuator 346 controls movement of the pleat die assembly 328. In the illustrated embodiments, the cam 368 is configured as a barrel cam connected to a shaft of the pleat actuator 346. Other embodiments, however, may include alternative mechanisms for moving the carriage relative to the positioning sleeve. For example, a pleat actuator may be connected to a positioning sleeve via a different type of cam and/or through any other type of linkage. Additionally or alternatively, some embodiments can include a cam actuator configured to rotate a cam independently from the actuation of the pleat actuator.

When the carriage actuator 350 is controlled to rotate the threaded rod 352 in a first direction, the threaded engagement between the threaded rod 352 and the positioning sleeve 358 may cause the carriage 332 (which is connected to the positioning sleeve 358 via the follower pin 366 and cam 368) to slide along the support rails 324 from the back end 308 of frame 302. When the threaded rod 352 is rotated in a second direction opposite the first direction, the positioning sleeve and the carriage 332 may be forced to slide back towards the back end 308 of frame 302.

Because the carriage 332 is linked to the positioning sleeve 358 through the cam 368, the joint module 326 may also be selectively moved towards and away from the back end 308 of frame 302 by pleat actuator 346 as it controls the pleat die assembly 328 to pleat an elongated tube. As the cam 368 is rotated, the carriage 332 may slide along the support rails 324, thereby moving longitudinally relative to the positioning sleeve 358. Rotation of the cam 368 by a first amount of rotation may move the carriage 332 in a first longitudinal direction relative to the frame 302 and rotation of the cam 368 by a second amount of rotation may move the carriage 332 in a second longitudinal direction relative to the frame 302. Thus, the carriage 332 may be moved at a first longitudinal speed by the carriage actuator 350 alone, a second longitudinal speed by the pleat actuator 346 and the cam 368, and/or a third longitudinal speed due to the combined movements of the carriage actuator 350 and the pleat actuator 346 and cam 368. The longitudinal movement speed of the carriage 332 relative to the back end 308 of the frame 302 may be controlled based on at least one of an actuation speed of the carriage actuator 350, an actuation speed of the pleat actuator 346, the size and/or shape of the cam 368, and any other factor. Using the carriage actuator 350 and/or the pleat actuator 346 and cam 368, the longitudinal movement speed of the carriage 332 can be adjusted too generally match the longitudinal movement speed of the tube through the roller stations. This may include moving the carriage 332 at a longitudinal speed that is the same as the longitudinal speed of the tube, slower than the longitudinal speed of the tube, or faster than the longitudinal speed of the tube based on the required speed to impart the desired pleat, crimp, and/or cut into the tube. In some embodiments, the pleat actuator 346 may be configured to rotate in a single direction such that the first and second amounts of rotation of the cam 368 are both made in the same rotational direction. Additionally or alternatively, the pleat actuator 346 can be configured to move the cam 368 in reciprocating motion such that the first amount of rotation is in a first direction and the second amount of rotation is in a second direction.

As with the embodiments of FIGS. 1-21, the carriage 332 may be rigidly connected to the shaft support and the shaft of the roll forming machine 300 so that the crimp die mandrel and the pleat die mandrel (which are secured to the shaft) move with the joint module 326 as it moves relative to the back end 308 of frame 302. This may be useful, for example, so that the pleat die assembly 328 may be moved longitudinally during the pleating process while alignment is maintained between the pleat die members 220 and the pleat die mandrel 248.

Figure 23:
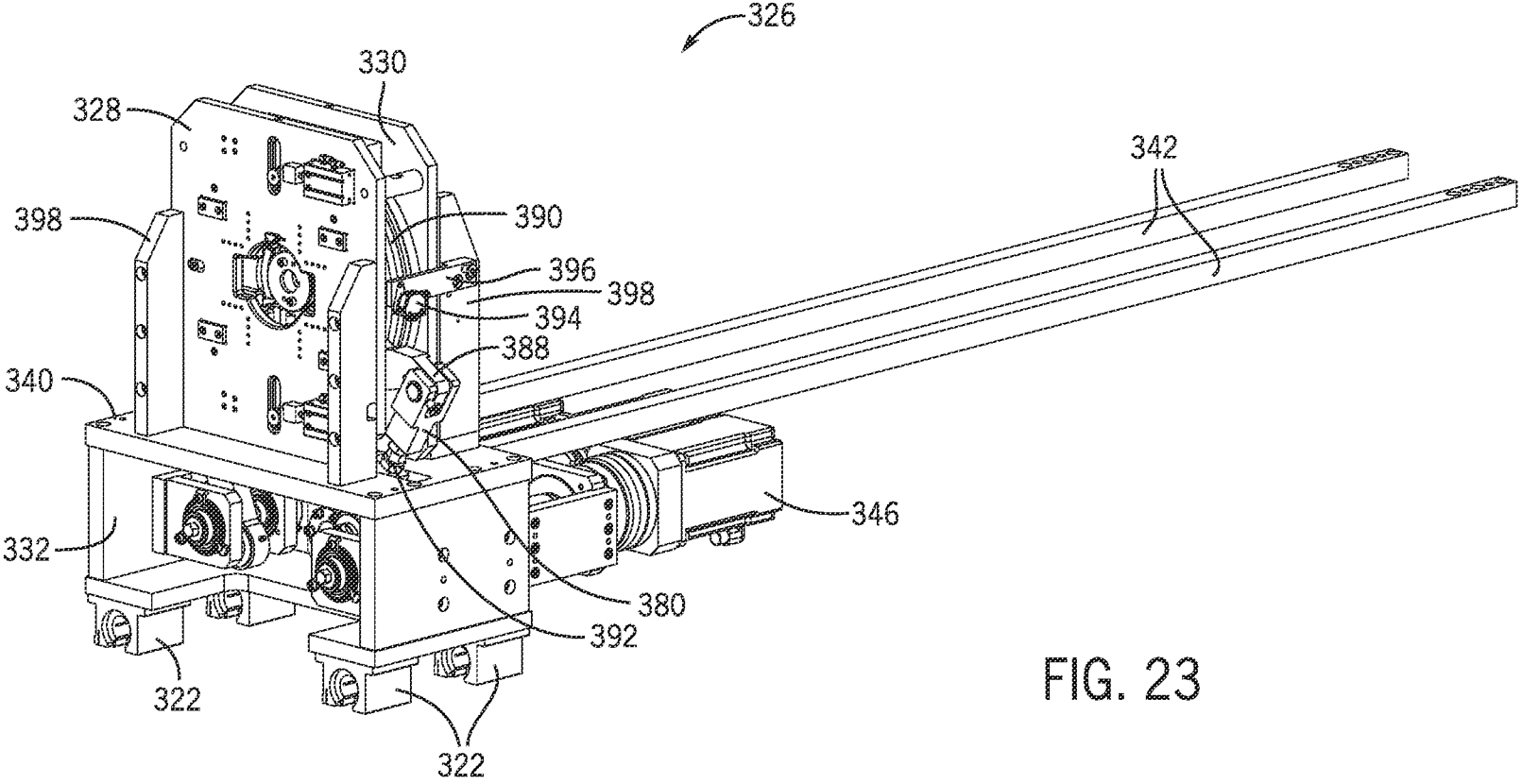
FIG. 23 is a perspective view of the joint module of FIG. 22.
Figure 24:
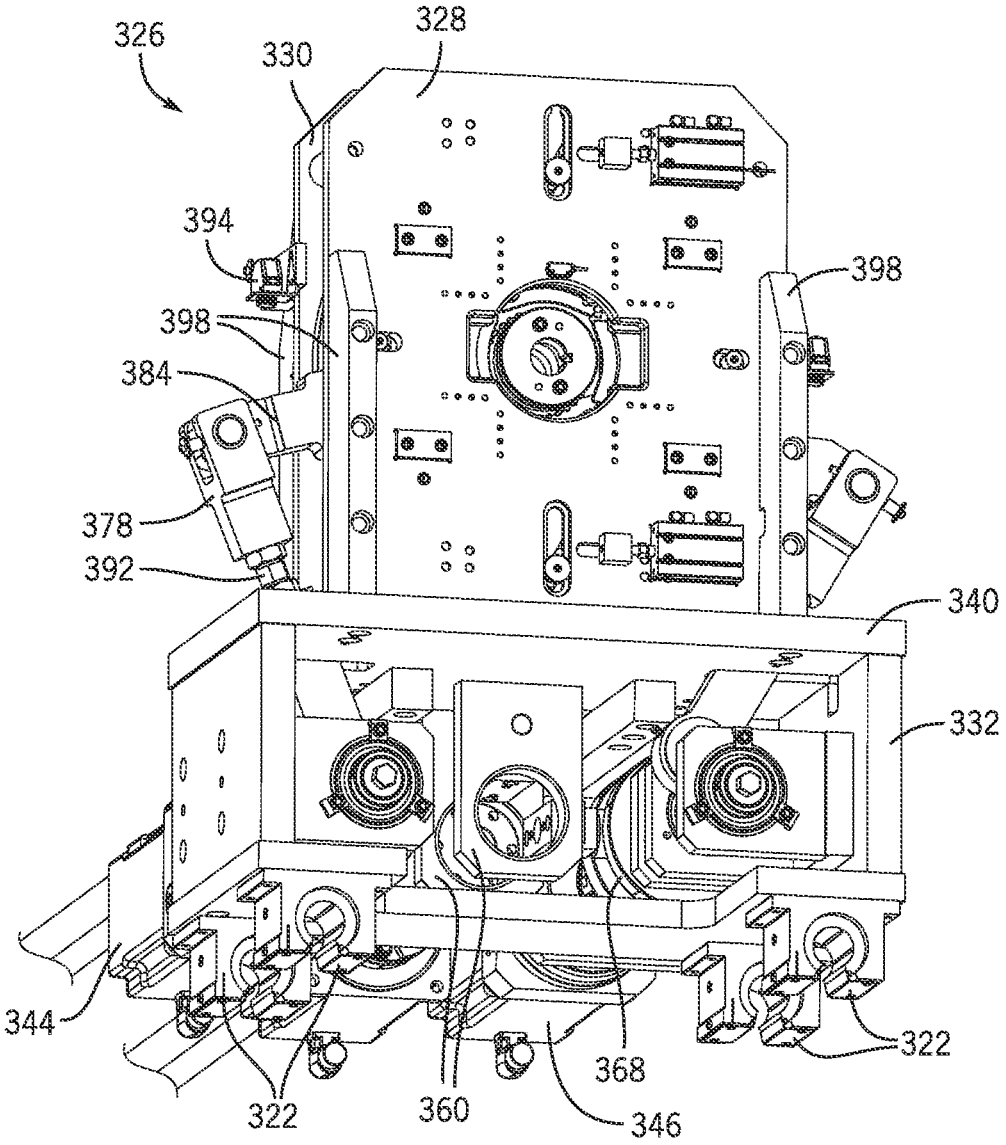
FIG. 24 is another perspective view of the joint of FIG. 23.
Figure 27:
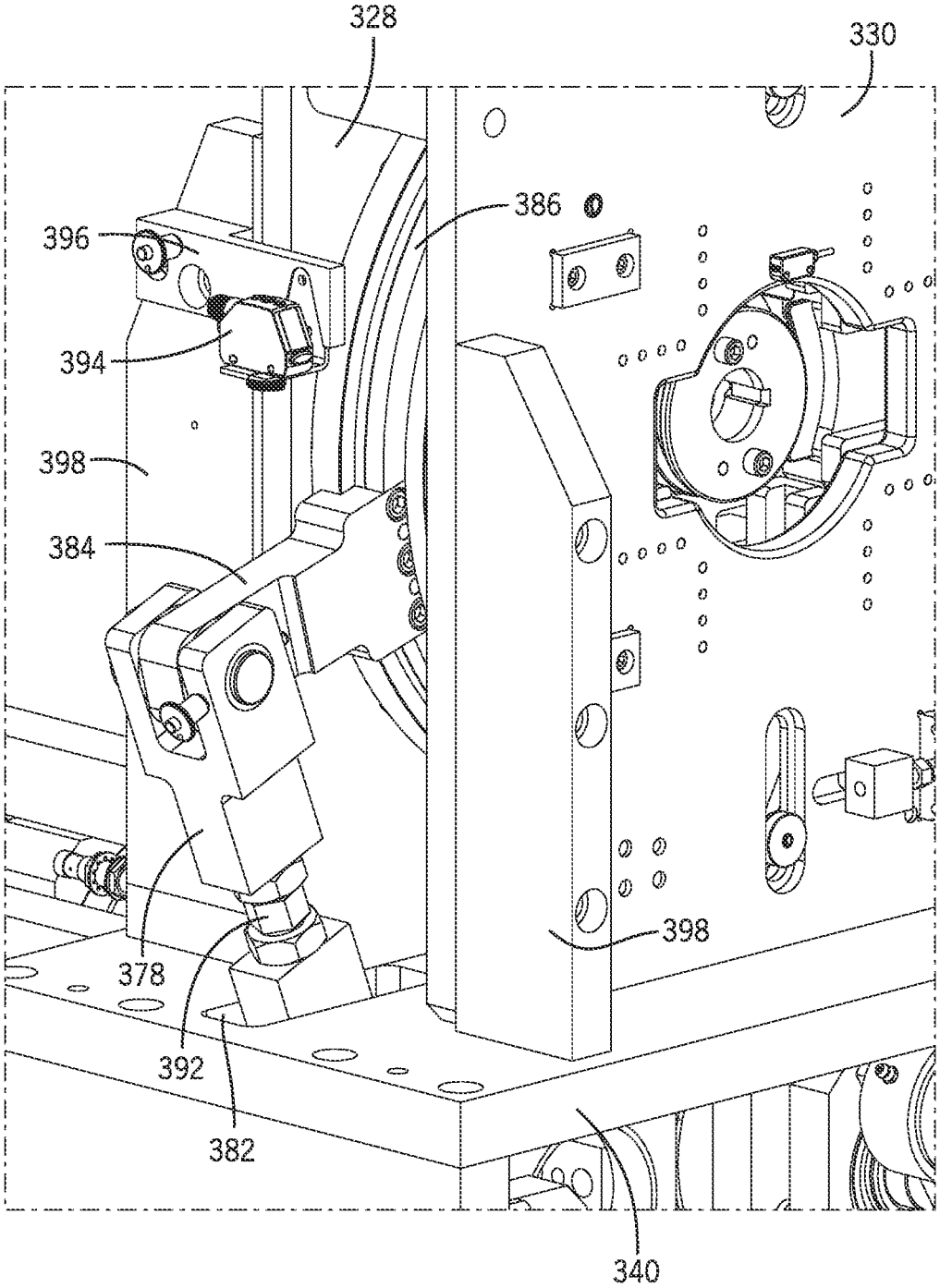
FIG. 27 is a detailed perspective view of an adjustment mechanism for the crimp die assembly in the joint module of FIG. 26.

Some embodiments of a joint module for a roll forming machine may be configured with at least one of an adjustable pleat die assembly and an adjustable crimp die assembly. For example, as illustrated in FIGS. 23, 24 and 27, the pleat die assembly 328 and the crimp die assembly 330 may include an adjustable bar linkage 378, 380 that extends through a corresponding slot 382 formed in the base 340 of the carriage 332 to respectively connect the crimp actuator 344 to the arm 384 extending from the crimp control ring 386 and the pleat actuator 346 to the arm 388 extending from the pleat control ring 390. Each of the adjustable bar linkages 378, 380 includes a turnbuckle 392 that may be adjusted to increase or decrease the length of the bar linkage 378, 380. When a turnbuckle 392 is adjusted to increase the length of one of the bar linkages 378, 380, the connected arm 384, 388 is pushed upward, thereby rotating the crimp control ring 386 or the pleat control ring 390 and respectively moving the crimp die members or the pleat die members radially inward. Adjusting the turnbuckles 392 to decrease the length of the bar linkages 378, 380 causes the crimp die members and the pleat die members to move radially outwardly without using the crimp actuator 344 or the pleat actuator 346.

The illustrated adjustment systems may be useful, for example, to adjust the expanded and contracted radial positions of the crimp die members and/or the extended and retracted radial positions of the pleat die members. The bend angle of a pleated joint section may be controlled based on the radial positions of the pleat die members. Moving the pleat die members radially inward may increase the bend angle of each pleat, while moving the pleat die members radially outward may decrease the bend angle of each pleat. This may be useful, for example, to control the bend angle of the joint section without changing the number of pleats used to form the joint section. Adjustment of the crimp die members may control the diameter of the crimped portion of a joint section. Moving the crimp die members radially outward may increase the diameter of the crimped portion of the joint, while moving the crimp die members radially inward may decrease the diameter of the crimped section. Because the crimp die members and the pleat die members are collectively controlled by the crimp control ring 386 or the pleat control ring 390, respectively, the adjustable bar linkages 378, 380 allow a user to modify the positions of all of the crimp die members or all of the pleat die members simultaneously by making a single adjustment to one of the turnbuckles 392.

While the illustrated adjustable bar linkages 378, 380 include a turnbuckle for adjusting their lengths, some embodiments can be configured with a different mechanism for changing the length of a bar linkage. Additionally or alternatively, at least one of the crimp die assembly and the pleat die assembly may be configured with a different mechanism for adjusting the radial positions of the respective die members. Further still, some embodiments may include an adjustment mechanism for independently adjusting the position of at least one of the crimp die members and/or at least one of the pleat die members.

In order to measure the positions of the crimp die members and/or the pleat die members, some embodiments of the joint module may include a laser measurement system. As illustrated in FIGS. 23, 24 and 27, the pleat die assembly 328 and the crimp die assembly 330 may include a laser sensor 394 that is connected to one of the mounting structures 398 by an positioning member 396 such that the laser sensor 394 is positioned over one of the arms 384, 388 extending from the crimp control ring 386 or the pleat control ring 390. Each of the laser sensors 394 can be configured to measure the distance between the laser sensor 394 and the corresponding arm 384, 388, and the measured distance can then be used to determine the radial positions of the corresponding crimp or pleat die members without manually measuring the die member positions. Using the data generated based on the laser sensor 294 measurements, a user can adjust the positions of the crimp die members and/or the pleat die members by increasing the length of the corresponding adjustable bar linkage 378, 380 (thereby decreasing the distance between the laser sensor and arm 384, 388) or decreasing the length of the corresponding adjustable bar linkage 378, 380 (thereby increasing the distance between the laser sensor and arm 384, 388).

In some embodiments of a joint module, at least one of the pleat die assembly and the crimp die assembly can be configured with a different system for determining the positions of the crimp die members and/or the pleat die members. For example, at least one of the laser sensors may be connected to a different part of the joint module, and at least one laser sensor may be configured to measure the position of a different part of the crimp or pleat die assembly. Some embodiments may include at least one different type of sensor configured to measure the position of one of the arms, or to measure a different dimension in order to determine the positions of the crimp or pleat die members. Further still, at least one of the crimp die assembly or the pleat die assembly may be configured without an adjustable bar linkage and/or a laser measurement system.

Figure 28:
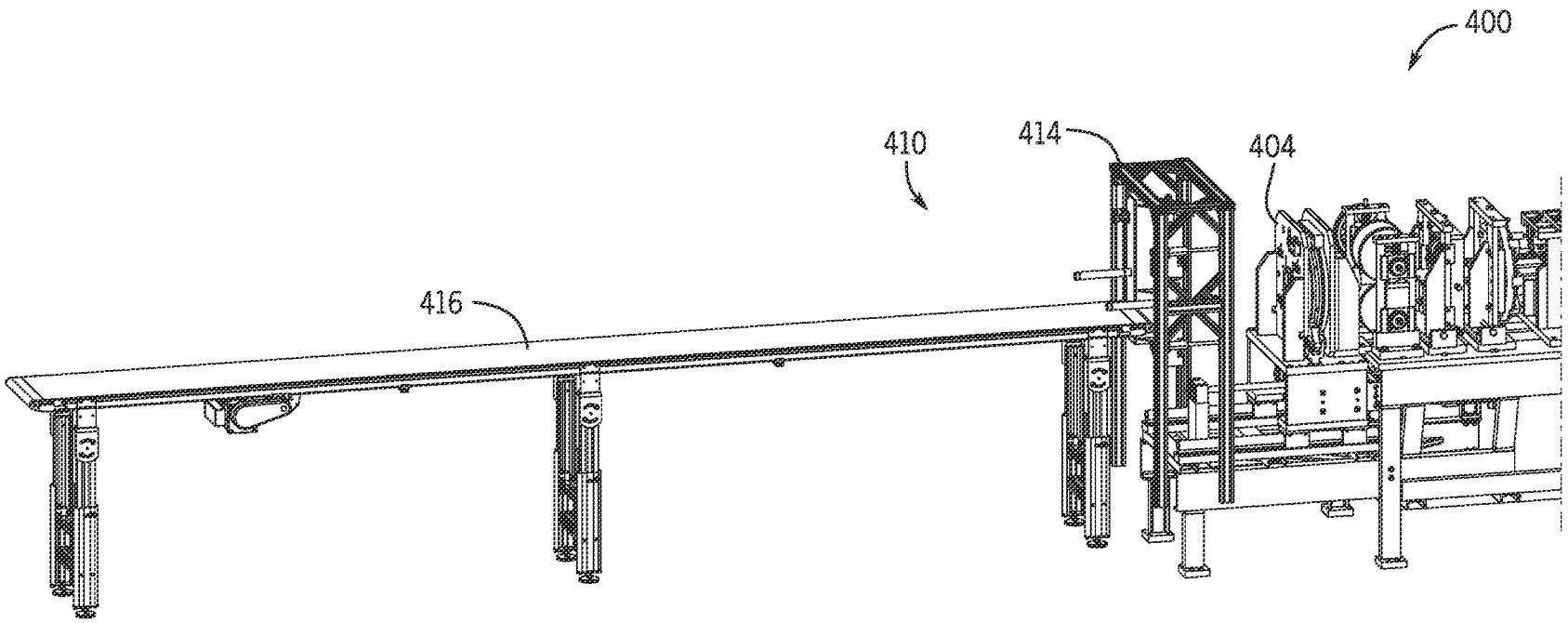
FIG. 28 is an embodiment of a roll forming machine including a joint module and an extractor module.

Some embodiments of a roll forming machine can include an extraction system configured to remove a roll formed tube or joint from the roll forming system. As illustrated in FIG. 28, for example, a roll forming machine 400 can include an extractor module 410 configured to remove a completed joint section of tube from the joint module 404 after completion. The ejector module may include an extractor 414 configured to pull the joint section away from the joint module 404 and a conveyor 416 configured to transport the joint section.

Figure 29:
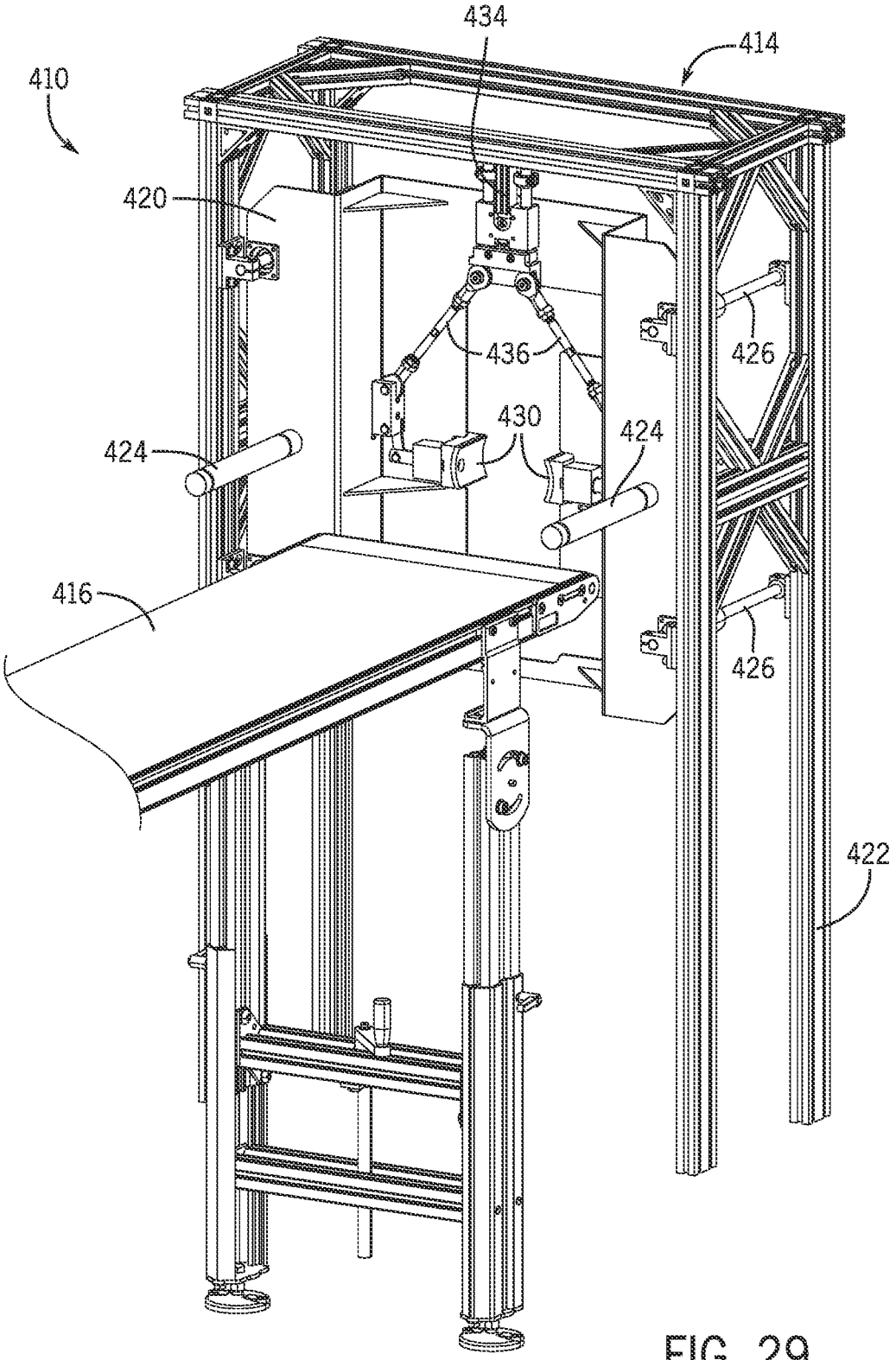
FIG. 29 is a detailed perspective view of the extractor module including an extractor and a conveyor of FIG. 28.
Figure 30:
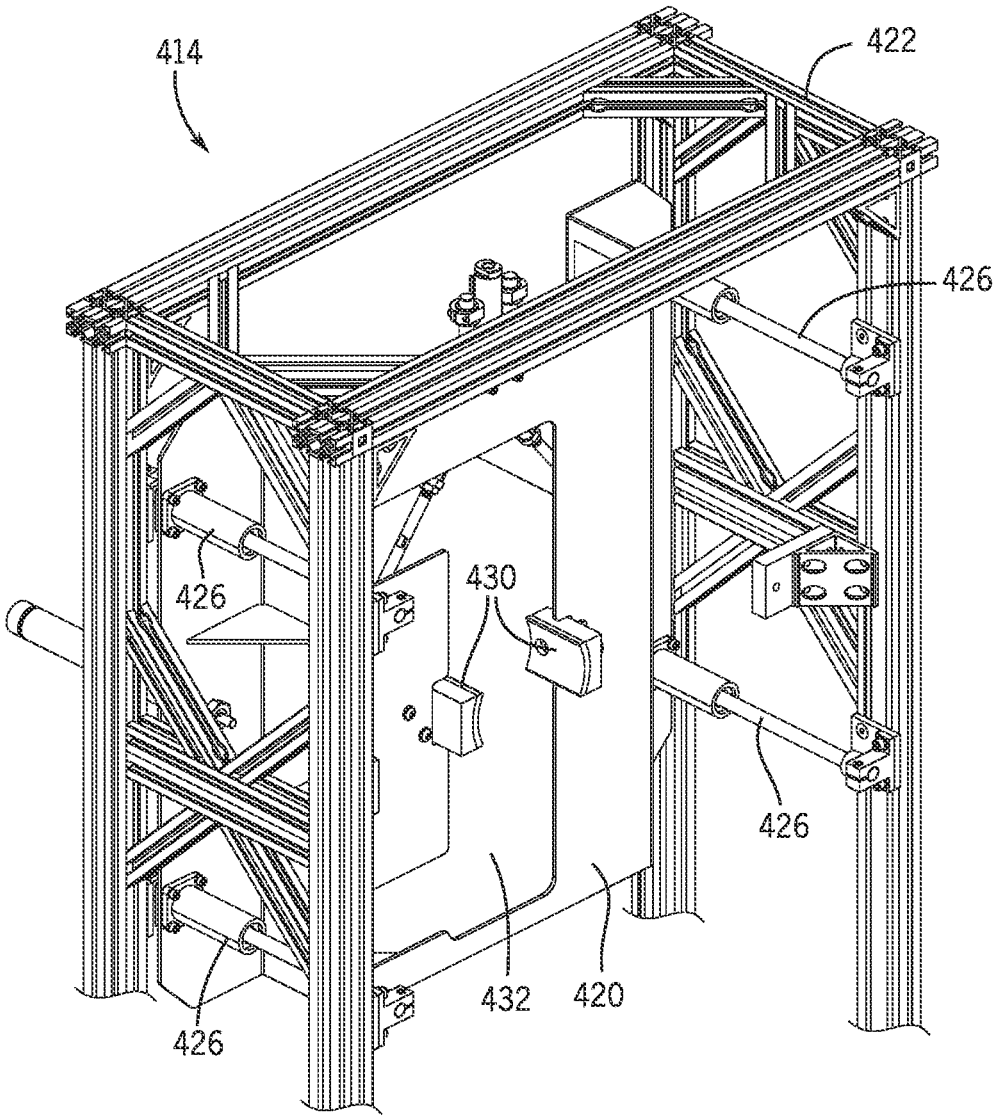
FIG. 30 is a detailed perspective view of the extractor of FIG. 29.
Figure 31:
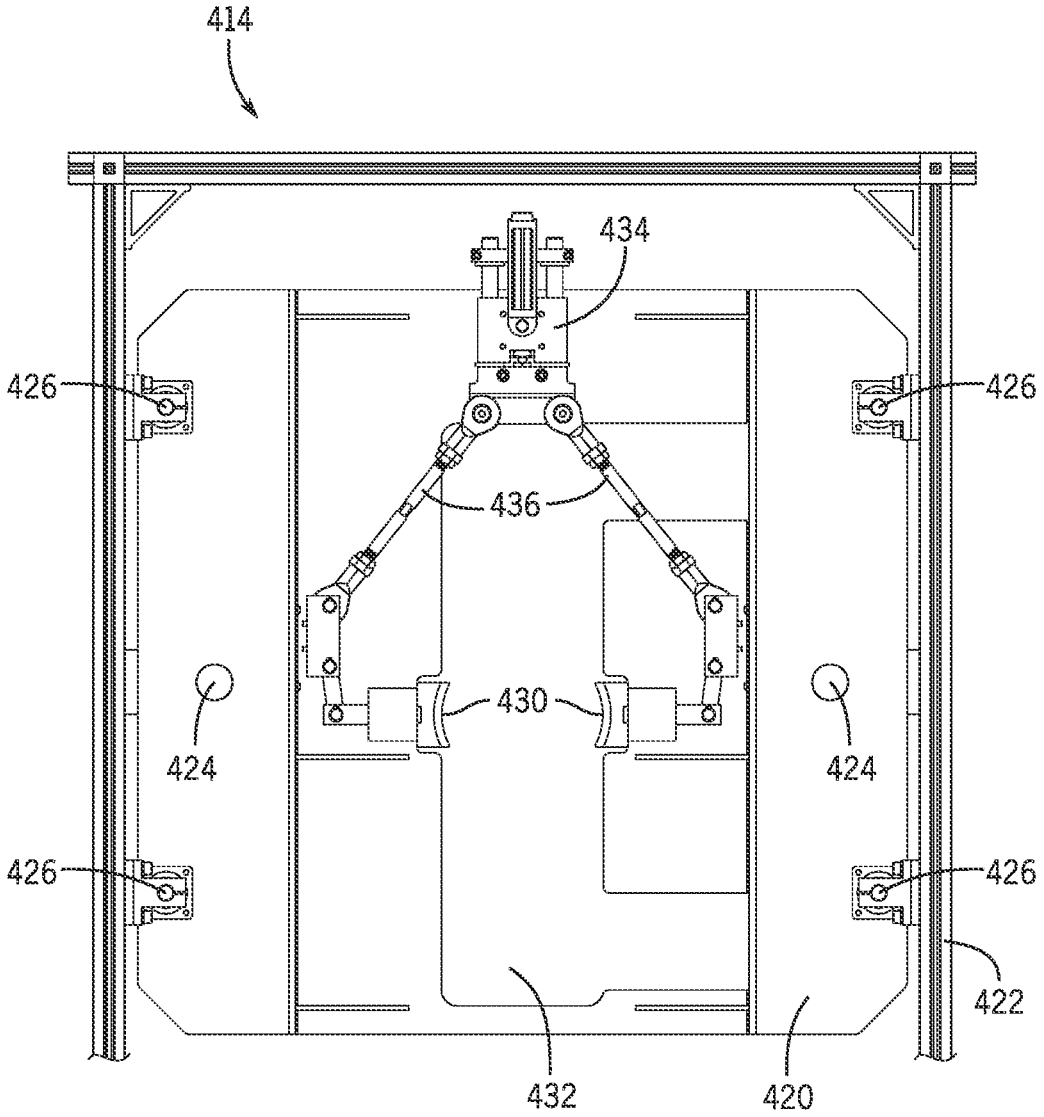
FIG. 31 is a rear view of the extractor of FIG. 30.

Referring to FIGS. 29-31, the extractor 414 may include an extractor carriage 420 slidably mounted on an extractor frame 422. Linear actuators 424 may be selectively controlled to slide the extractor carriage 420 along rails 426 extending between the front side and the back side of the extractor frame 422. The extractor 414 includes jaws 430 positioned on opposite sides of an opening 432 that is formed through the extractor carriage 420. In the illustrated embodiments, the extractor 414 includes two jaws positioned on opposite lateral sides of the opening 432. Some embodiments, however, may include at least one additional jaw, and at least one jaw may be differently positioned than the illustrated jaws.

A jaw actuator 434, which may be connected to the jaws 430 by a bar linkage assembly 436, is configured to selectively slide the jaws 430 between a retracted position and an extended position. In the retracted position (see, for example FIGS. 29-31), the jaws 430 may be positioned proximate the edge of the opening 432 so that a roll formed tubular joint section may be received through the opening 432. As they are move towards their extended positions, the jaws 430 slide inward towards each other and the middle of the opening 432. When a portion of a joint section (or a straight roll formed tube) is positioned within the opening 432, the jaws 430 may be configured to grip the joint section so that is supported on the extractor carriage 420. As the jaws 430 are returned to their retracted positions, any roll formed tube or joint may be released and dropped from the extractor carriage 420.

When used to remove a completed joint section of tube from the joint module 404, the linear actuators 424 may be configured to move the extractor carriage 420 towards the front of the extractor frame 422 to await completion of the pleating, crimping, and cutting processes of the joint module 404. As the joint section is formed, it may extend out of the end of the joint module 404 and enter into the opening 432 in the extractor carriage 420. Once the joint section is positioned within the opening 432, the jaws 430 can be controlled to move to their extended positions to grip the joint section before it is cut away from the elongated tube still moving through the roll forming machine 400. Once the joint section is severed from the elongated tube by the crimp die on the joint module 404, the linear actuators 424 may slide the extractor carriage 420 back towards the rear of the extractor frame 422, thereby moving the joint section away from the joint module 404 and towards the conveyor 416. When the extractor carriage 420 reaches the back side of the extractor frame 422, the jaws 430 can be controlled to return to their retracted positions in order to deposit the joint section on the conveyor 416.

Many alternative configurations for an ejector module will be recognized by one of ordinary skill in the art, and such configurations are intended to be within the scope of the present application. For example, a roll forming machine may include an extractor that is integrated with an elbow module. Additionally or alternatively, some embodiments of an ejector module may be configured without a conveyor system.

Figure 32:
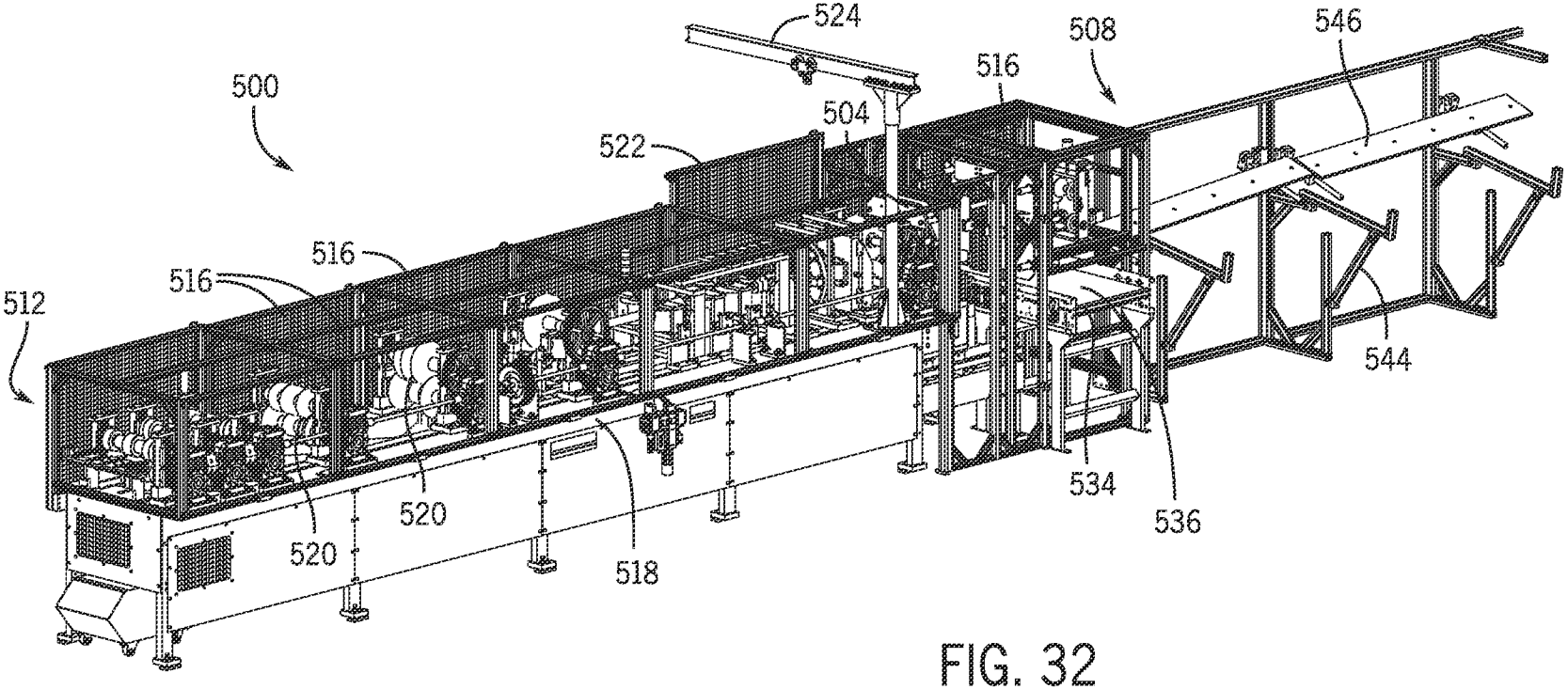
FIG. 32 is an embodiment of a roll forming machine including a joint module, joint extractor, and tube extractor with a collection table.

Referring now to FIG. 32, another embodiment of a roll forming machine 500 including a joint module 504, an extractor module 508 and an enclosure 512 is illustrated. The enclosure 512 include a plurality of enclosure walls 516 positioned around the edges of the frame 518 of the roll forming machine 500 to enclose at least one of the roller stations 520, the joint module 504 and/or the extractor module 508. In order to provide a clear view of the roll forming machine 500, the wire mesh that forms the illustrated enclosure walls 516 has only been included on one side of the roll forming machine 500 in FIG. 32. It should be appreciated that wire mesh enclosure walls may additionally or alternatively be provided on at least one other side of the machine. This may be useful, for example, to prevent unauthorized or incidental insertion of an object into the roll forming machine 500. At least one of the walls 516 may be configured as an openable wall 522 that can be moved from a closed position to an open position to provide access to the roll forming machine 500 when desired. While the illustrated enclosure walls 516, 522 are formed from a wire mesh, other embodiments may include walls formed from a different material, such as plexiglass or any other material. Additionally or alternatively, some embodiments may include a jib 524 that extends laterally across the frame 518 from a left side to a right side thereof. The jib 524 may be connected to a lift system (for example, a pulley or other lifting mechanism), and can be used to move components onto or off of the roll forming machine 500.

Figure 33:
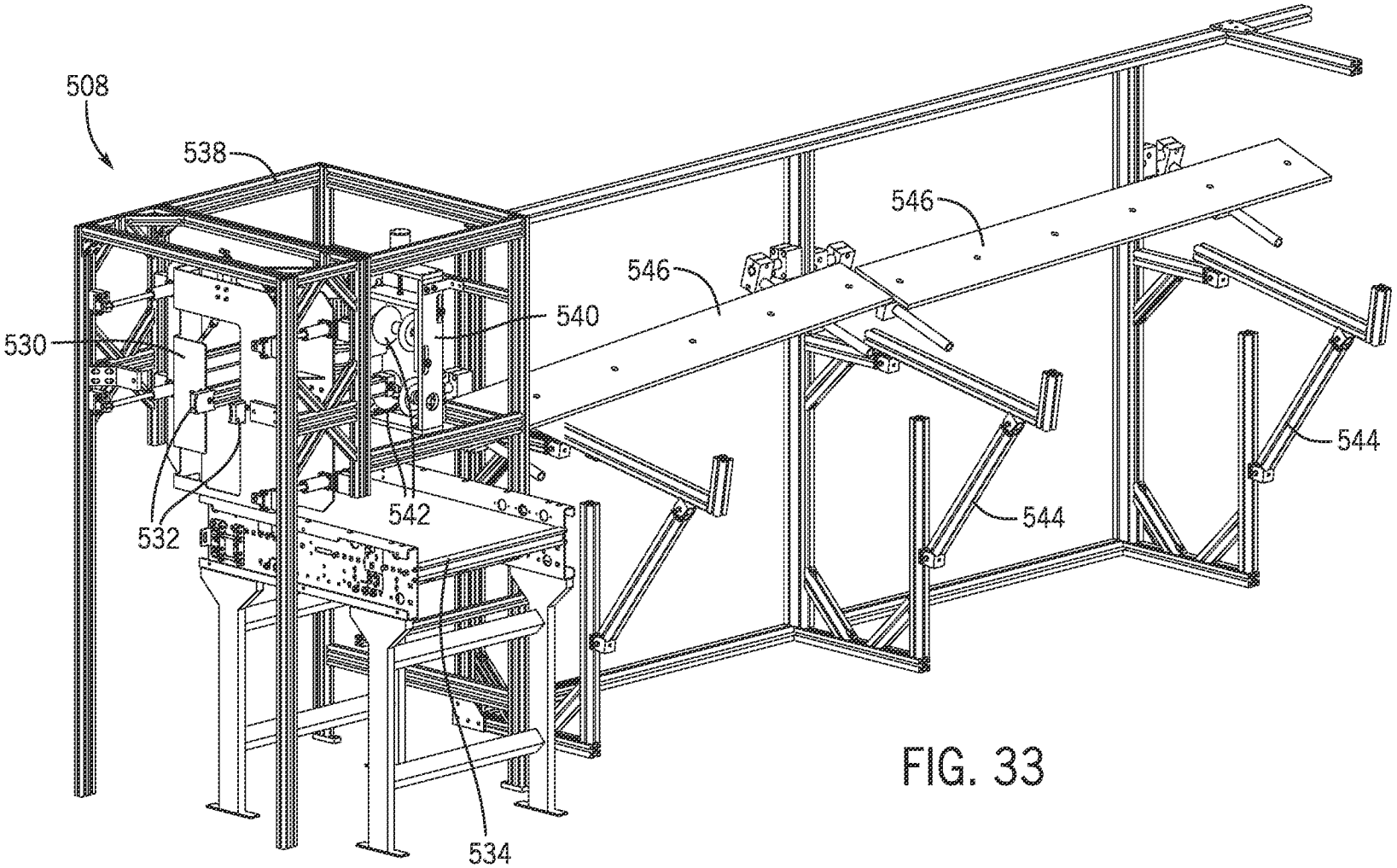
FIG. 33 is a perspective view of the joint extractor and tube extractor with collection table of FIG. 32.
Figure 34:
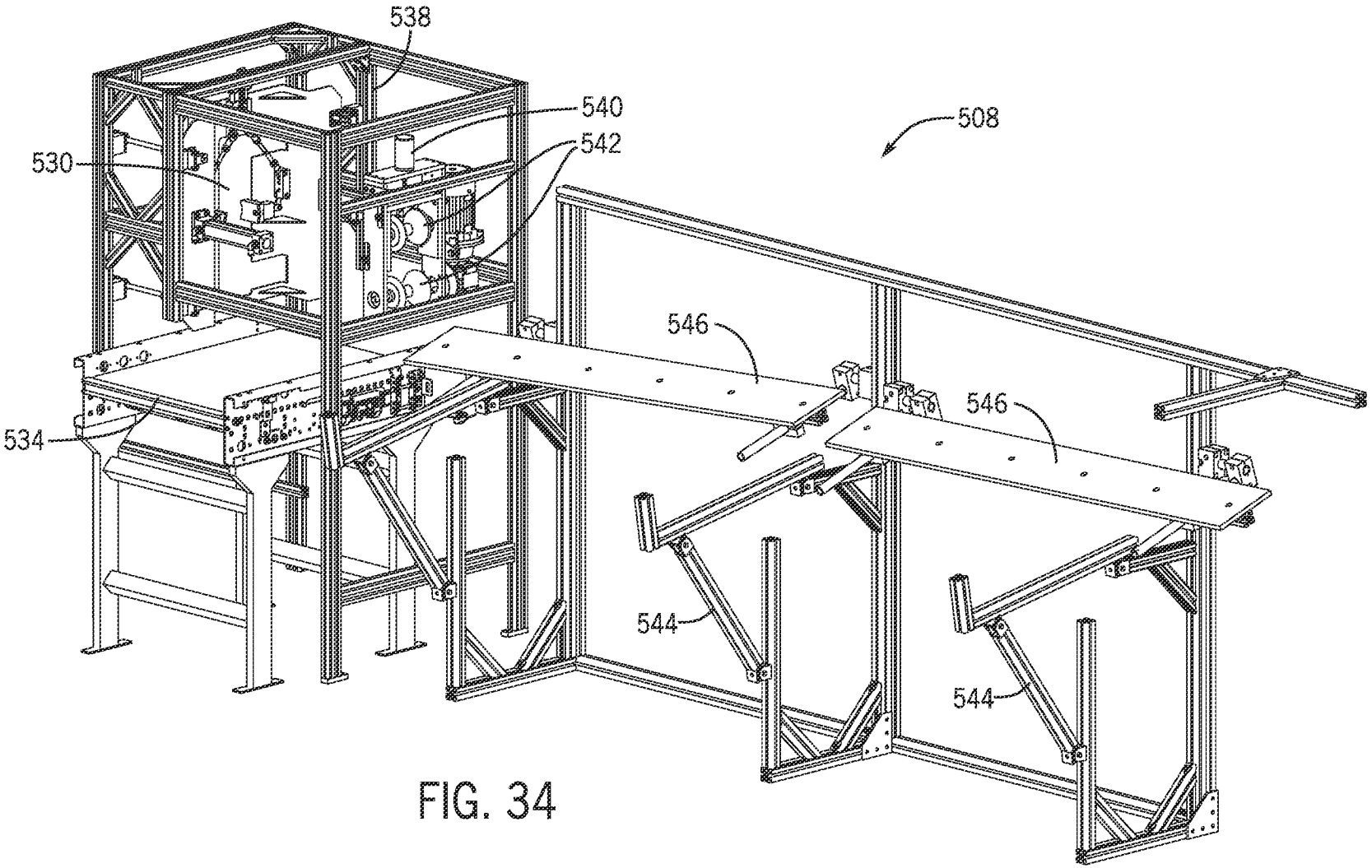
FIG. 34 is another perspective view of the joint extractor and tube extractor with collection table of FIG. 33.

FIGS. 33 and 34 illustrate an embodiment of an extractor module 508 that may be used with the roll forming machine 500 of FIG. 32, or any other embodiment of a roll forming machine. Similarly to the extractor module of FIGS. 28-31, the extractor module 508 may include an extractor 530 with retractable jaws 532 configured to grip a joint segment, pull it away from the joint module, and deposit the joint segment on a conveyor system 534. The conveyor system 534 of the illustrated embodiment, however, is configured to convey a joint segment laterally relative to the frame 518 so that the joint section can be received through an opening 536 formed in the side of the enclosure 512 (see FIG. 32). Additionally or alternatively, the extractor module 508 can include a roller assembly 540 secured to the extractor frame 538 such that it is in alignment with the extractor 530. When the roll forming machine is used to produce an elongated tube or joint section, the completed tubular section may extend through the jaws 532 of the extractor 530 and into the roller assembly 540. At least one roller 542 may be moved into engagement with the elongated tube or joint section, and may be powered to move the tubular section longitudinally away from the joint module and onto a receiving rack 544. Some embodiments may include at least one positionable guide 546 to guide the elongated tube or joint section as it is moved onto the receiving rack 544.

It is to be appreciated that features depicted in conjunction with any one of the illustrated embodiments may be used in conjunction with the features of any other embodiment of the invention. In the above description, certain terms have been used for brevity, clarity, and understanding. No unnecessary limitations are to be inferred therefrom beyond the requirement of the prior art because such terms are used for descriptive purposes and are intended to be broadly construed. The different systems described herein may be used alone or in combination with other systems. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A roll forming machine for continuously forming a sheet into a joint section of a tube, the roll forming machine comprising:

a frame having a front end and a back end;

a plurality of roller stations arranged longitudinally on the frame between the front end and the back end and configured to move the sheet along the frame from the front end to the back end and to bend the sheet to form the tube;

a carriage slidably secured to the frame;

a pleat die assembly mounted on the carriage and configured to repeatedly engage the tube to form a series of pleats thereby bending the tube to form the joint section;

a crimp die assembly mounted on the carriage and configured to engage the tube to crimp an end of the joint section and to sever the end of the joint section from the tube; and wherein the carriage moves relative to the frame while the tube is engaged with at least one of the crimp die assembly and the pleat die assembly.

2. The roll forming machine of claim 1, further comprising a pleat actuator secured to the carriage and configured to selectively actuate the pleat die assembly by moving a plurality of pleat die members radially into engagement with the tube; and a crimp actuator secured the carriage and configured to selectively actuate the crimp die assembly by moving a plurality of crimp die members radially into engagement with the tube.

3. The roll forming machine of claim 2, wherein the carriage further comprises a cam configured to be rotated by the pleat actuator a first amount of rotation as the plurality of pleat die members engage the tube and a second amount of rotation as the plurality of pleat die members are disengaged from the tube; and wherein the first amount of rotation of the cam slides the carriage in a first longitudinal direction relative to the frame and the second amount of rotation of the cam slides the carriage in a second longitudinal direction relative to the frame.

4. The roll forming machine of claim 3, wherein the pleat die assembly further comprises a pleat engagement actuator configured to selectively disengage at least one of the plurality of pleat die member from the pleat actuator such that the at least one disengaged pleat die member is not moved into radial engagement with the tube.

5. The roll forming machine of claim 2, further comprising an adjustable bar linkage operatively connecting the pleat actuator to the pleat die members or the crimp actuator to the crimp die members; and wherein the length of the adjustable bar linkage can be selectively increased or decreased to adjust the radial positions of the corresponding one of the pleat die members or the crimp die members.

6. The roll forming machine of claim 1, further comprising a carriage actuator configured to selectively slide longitudinally relative to the frame; and wherein the carriage actuator is configured to match a speed of the tube through the roller stations such that the carriage moves with the tube.

7. The roll forming machine of claim 6, wherein the carriage is linked to the carriage actuator by a cam configured to be rotated by a pleat actuator; and wherein rotation of the cam slides the carriage longitudinally relative to the frame independently from the carriage actuator.

8. The roll forming machine of claim 6, wherein the carriage is connected to the carriage actuator via a positioning sleeve that is received on a threaded rod and is in threaded engagement with the threaded rod; and wherein the carriage actuator is configured to rotate the threaded rod in a first direction to drive the positioning sleeve and carriage longitudinally away from back end of the frame or in a second direction to drive the positioning sleeve and carriage longitudinally towards the back end of the frame.

9. The roll forming machine of claim 1, further comprising an extractor module configured to extract the joint section from at least one of the pleat die assembly and the crimp die assembly once the joint section has been severed from the tube by the crimp die assembly.

* * * * *